US009746294B2

(12) United States Patent
Palomaki et al.

(10) Patent No.: US 9,746,294 B2
(45) **Date of Patent: *Aug. 29, 2017**

(54) LOBED NOCK FOR CROSSBOW BOLTS

(71) Applicant: Easton Technical Products, Inc., Salt Lake City, UT (US)

(72) Inventors: Teddy D. Palomaki, Park City, UT (US); Chad R. Peterson, Layton, UT (US); Kenny R. Giles, West Valley City, UT (US)

(73) Assignee: EASTON TECHNICAL PRODUCTS, INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/260,177

(22) Filed: Sep. 8, 2016

(65) Prior Publication Data

US 2017/0030691 A1 Feb. 2, 2017

Related U.S. Application Data

(63) Continuation of application No. 14/814,783, filed on Jul. 31, 2015, now Pat. No. 9,441,925.

(51) Int. Cl.

| | |
|---|---|
| ***F42B 6/06*** | (2006.01) |
| ***F41B 5/12*** | (2006.01) |
| ***F42B 6/04*** | (2006.01) |

(52) U.S. Cl.

CPC ..... *F42B 6/06* (2013.01); *F41B 5/12* (2013.01); *F42B 6/04* (2013.01)

(58) Field of Classification Search

CPC ..... F41B 5/12; F42B 6/06

See application file for complete search history.

(56) References Cited

U.S. PATENT DOCUMENTS

| | | | | |
|---|---|---|---|---|
| 3,865,374 | A | 2/1975 | Troncoso, Jr. | |
| 5,465,979 | A | 11/1995 | Buhler | |
| 5,897,449 | A | 4/1999 | Roberts et al. | |
| 6,205,990 | B1 | 3/2001 | Adkins | |
| 6,425,386 | B1 | 7/2002 | Adkins | |
| 7,770,567 | B1 | 8/2010 | Yehle | |
| 8,216,097 | B2 | 7/2012 | Nick et al. | |
| 8,622,855 | B2 | 1/2014 | Bednar et al. | |
| 9,074,837 | B2 | 7/2015 | Bednar et al. | |
| 9,441,925 | B1 * | 9/2016 | Palomaki | F42B 6/06 |
| 2014/0083406 | A1 | 3/2014 | Bednar et al. | |
| 2015/0105191 | A1 | 4/2015 | Pedersen et al. | |

* cited by examiner

*Primary Examiner* — John Ricci

(74) *Attorney, Agent, or Firm* — Holland & Hart

(57) ABSTRACT

A lobed projectile includes a shaft having a leading end and a trailing end, a point positioned at the leading end, a number of circumferentially spaced apart vanes positioned on the shaft between the leading end and the trailing end, and a nock positioned at the trailing end. The nock includes a body portion attached to the shaft, wherein the body portion has a central axis, and the nock includes a lobe on the outer surface of the body portion which extends radially away from the central axis. The nock may be used to avoid dry fires of a crossbow by controlling an anti-dry fire mechanism and by securing a bowstring to the nock of the projectile.

21 Claims, 22 Drawing Sheets

1010
1000
1002
1007
1010
1000
320
312
318
316
322
324

1002
1000
1010
1005
1007
1000
1010
1005
1007
1004
1000
1005
1007

1010
1000
1002
1000
1010
1000
1010

120
1005
1004
1005
1007
1000
1010
1003
1000
1002

1005
1000
1002
1007
1000
1005
1010
1007
1004
1010
1007
1000
1007
1005
1010

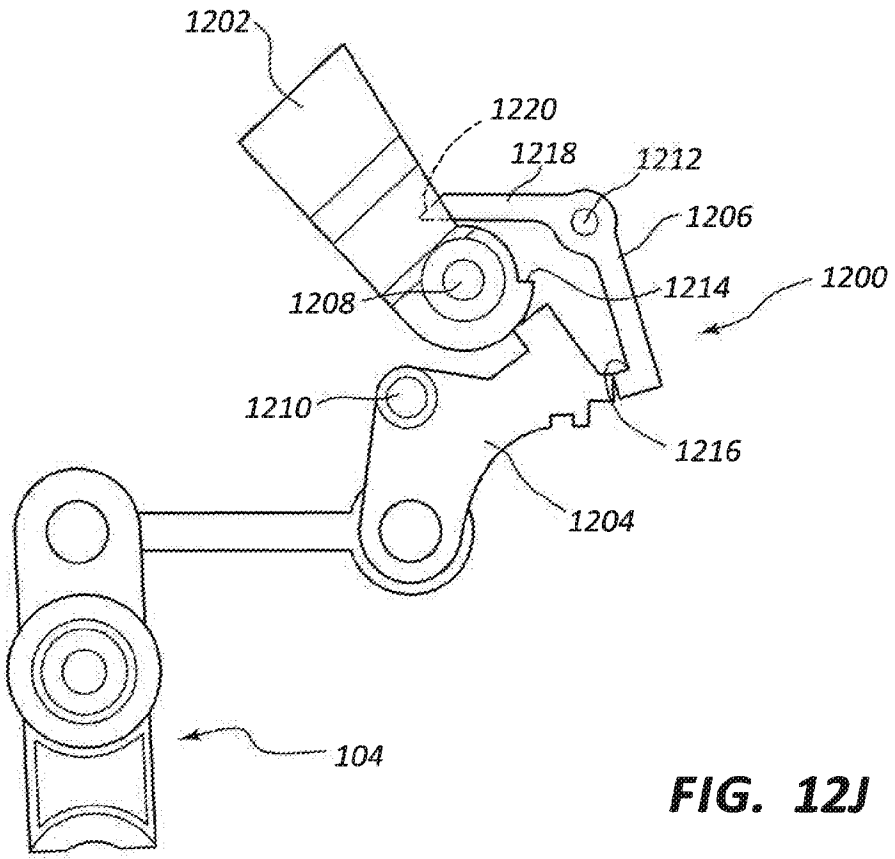
FIG. 12J
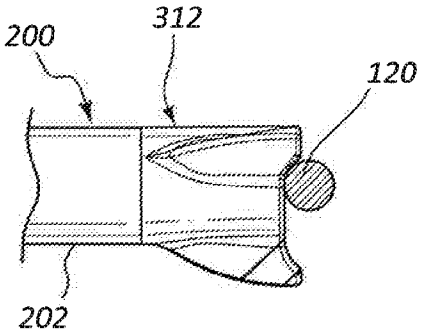

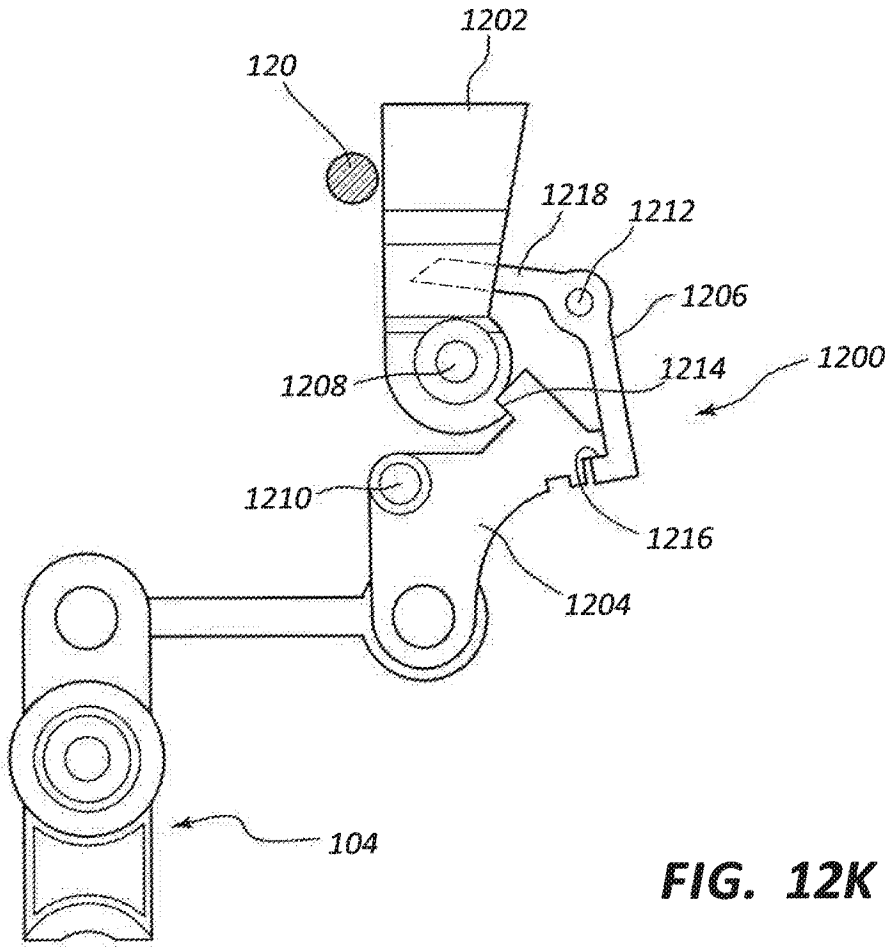
FIG. 12K
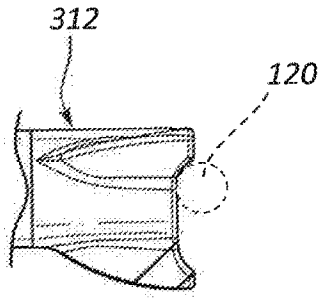

LOBED NOCK FOR CROSSBOW BOLTS

RELATED APPLICATION

This is a continuation of U.S. patent application Ser. No. 14/814,783 tiled on 31 Jul. 2015, now U.S. Pat. No. 9,441,925, issued on 13 Sep. 2016, the disclosure of which is incorporated, in its entirety, by this reference.

TECHNICAL FIELD

The present disclosure generally relates to nocks for projectiles used in archery bows and crossbows and particularly relates to locks with circumferentially spaced lobes for use in crossbows.

BACKGROUND

Bow and crossbow archers constantly seek ways to improve the accuracy and reliability of their bows and crossbows. One way to improve accuracy and reliability is to control the orientation of the projectile (e.g., an arrow or bolt) when it is launched from the bow or crossbow. In an archery bow (e.g., a compound bow or recurve bow), the fletchings or vanes of the arrow should be oriented so that they have minimal interference with the cables, arrow rest, and riser as the arrow is launched. Similarly, in a crossbow the fletchings or vanes of the bolt must be properly oriented to avoid conflicting contact with the rails as the bolt is launched.

The nock at the trailing end of an arrow or bolt may also affect the reliability of the bow. For example, it may be possible to dry fire a bow or crossbow (i.e., release the string without launching an arrow) if the bowstring is able to slip laterally around the trailing end of the arrow and move along the shaft of the projectile when the bowstring is released. When a dry fire occurs, the energy that otherwise would be transmitted to the projectile is absorbed by the bow or crossbow, Which can cause undesirable consequences.

The trailing end of an arrow or bolt for a crossbow, for example, most often includes a nock to help orient the projectile relative to the crossbow and to keep the bowstring secured to the projectile until it reaches the proper release position. A half-moon nock, for example, may be attached to a bolt so that when a crossbow's bowstring extends across and within the half-moon shaped groove of the nock, an index vane of the bolt is properly oriented between rails of the crossbow. When the bowstring is released, the C-shaped or V-shaped groove at the end of the nock keeps the bowstring aligned directly with the longitudinal axis of the shaft of the bolt to avoid a situation where the bowstring slips to one side of the nock when the bolt is launched from the crossbow. The force of the bowstring is therefore efficiently and properly transferred to the projectile.

However, some of these types of locks have drawbacks. Nocks and vanes are typically secured to the bolt shafts as part of an assembly process performed by manufacturers or by end-users. These processes are susceptible to imperfections and errors that can affect the nook's orientation and performance. If a vane or half-moon nock is not attached correctly to a bolt shaft, the index vane may not be oriented to the bowstring properly when loaded into a crossbow. As such, the vane may undesirably drag against the crossbow rails when the bowstring is released or the bowstring will not seat and engage the nock correctly. A misaligned nock may cause the bolt to be pushed to one side during the launch process, thereby affecting the bolt's flight and potentially causing a dry fire. Additionally, even if the nock is properly attached to the shaft, the archer may load the bolt incorrectly (e.g., using the wrong vane as an index vane) and may thereby inhibit proper interaction between the nock and the bowstring.

Some nock makers have engineered nocks with multiple rear groove shapes in order to reduce the chance that a bolt is improperly loaded into the crossbow. These nocks are nevertheless still vulnerable to misalignment by the manufacturer or end user and may not provide enough grip to keep the bowstring seated against the bolt, so the potential for dry fires is still present. Crossbows conventionally use some kind of anti-dry fire (ADF) mechanism to prevent release of the bowstring unless a bolt is loaded onto the crossbow, but such devices do not determine the orientation (rotational or longitudinal) of the bolt relative to the crossbow, and thus an improperly loaded bolt may result in a dry fire. There is therefore a need for improvements to existing archery nocks and anti-dry fire devices.

SUMMARY

One aspect of the present disclosure relates to a lobed nock for a projectile which may comprise a shaft having a leading end and a trailing end, a point positioned at the leading end, a plurality of circumferentially spaced apart vanes positioned on the shaft between the leading end and the trailing end, and a nock positioned at the trailing end. The neck may comprise a body portion attached to the shaft, wherein the body portion has a central axis, and a lobe on the outer surface of the body portion, wherein the lobe extends radially away from the central axis.

In some embodiments, the lobe is longitudinally aligned with one of the plurality of circumferentially spaced apart vanes. The nock may comprise a plurality of lobes on the outer surface of the body portion and extend radially away from the central axis. The nock may include a plurality of bowstring seats, with each of the bowstring seats being formed by at least two of the lobes of the plurality of lobes. In some cases the bowstring seats each have a seat axis and the seat axes may collectively form a triangle relative to the body portion. Some embodiments of the projectile may comprise a bowstring seat having an at least partially cylindrical bowstring contact surface.

The body portion of the nock may have a rear surface and the lobe may extend rearward from the body portion relative to the rear surface. The rear surface may be flat and/or recessed. The lobe may comprise a retaining surface facing the body portion.

Another aspect of the disclosure relates to a nock for an archery arrow or bolt, which comprises a front end portion configured to be inserted into an arrow or bolt, with the front end portion having a longitudinal axis and a rear end portion configured to extend rearward from the arrow or bolt upon insertion of the front end portion into the arrow or bolt. A lobe may be attached to the rear end portion and may extend away from the rear end portion in a radial direction relative to the longitudinal axis.

A plurality of lobes may be attached to the rear end portion and may radially extend away from the rear end portion relative to the longitudinal axis. The plurality of lobes may be circumferentially spaced apart around the rear end portion. One of the plurality of lobes may be configured to extend in a vertical direction away from the rear end portion and at least two other lobes of the plurality of lobes extend laterally relative to the vertical direction. The rear end portion may have a flat rear surface. The rear end portion may have a central portion and a peripheral portion, with the central portion being recessed relative to the peripheral portion. The lobe may extend rearward from the rear end portion and may have a curved rear surface.

The rear end portion may have an at least partially cylindrical bowstring contact surface. The cylindrical bowstring contact surface may be positioned relative to the rear end portion such that a bowstring contacting the cylindrical bowstring contact surface intersects the longitudinal axis of the nock. The lobe may also have a flat or pointed outer surface facing radially away from the longitudinal axis.

Yet another aspect of the disclosure relates to a nock-based bolt detection system for a crossbow. The system may comprise a crossbow bolt that is connected to a nock, with the nock having a lobe extending radially outward from the nock. The system may also include a crossbow having a front end and a rear end, two laterally-extending limbs, and a bowstring connected to the limbs. A string retaining member may be configured to retain the bowstring when the bowstring is under tension, with the string retaining member being configured to release the bowstring when shooting the crossbow. The system may also have a nock contact member having a first position relative to the crossbow wherein the nock contact member prevents release of the bowstring from the string retaining member and having a second position relative to the crossbow wherein the nock contact member does not prevent release of the bowstring from the string retaining member. The nock contact member may be configured to move between the first position and the second position by contacting the lobe of the bolt.

Furthermore, the string retaining member may be biased to a bowstring retaining position. The nock contact member may be biased to a bowstring release prevention position. The nock may comprise at least one additional lobe positionable above the bowstring while the nock contact member is in the second position. The bowstring may comprise an outer surface having a cross-sectional profile, and the at least one additional lobe may comprise a surface having a shape following the cross-sectional profile of the bowstring.

The bolt may also include a vane, with the lobe being longitudinally aligned with the vane. The crossbow may have rails, with the lobe being positioned between the rails. The nock contact member may be pivotable between the first and second positions.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

FIGS. 12A-12K show step-by-step views of the operation and parts of an anti dry fire (ADF) and firing mechanism of a crossbow according to an embodiment of the present disclosure.

Figure 1:
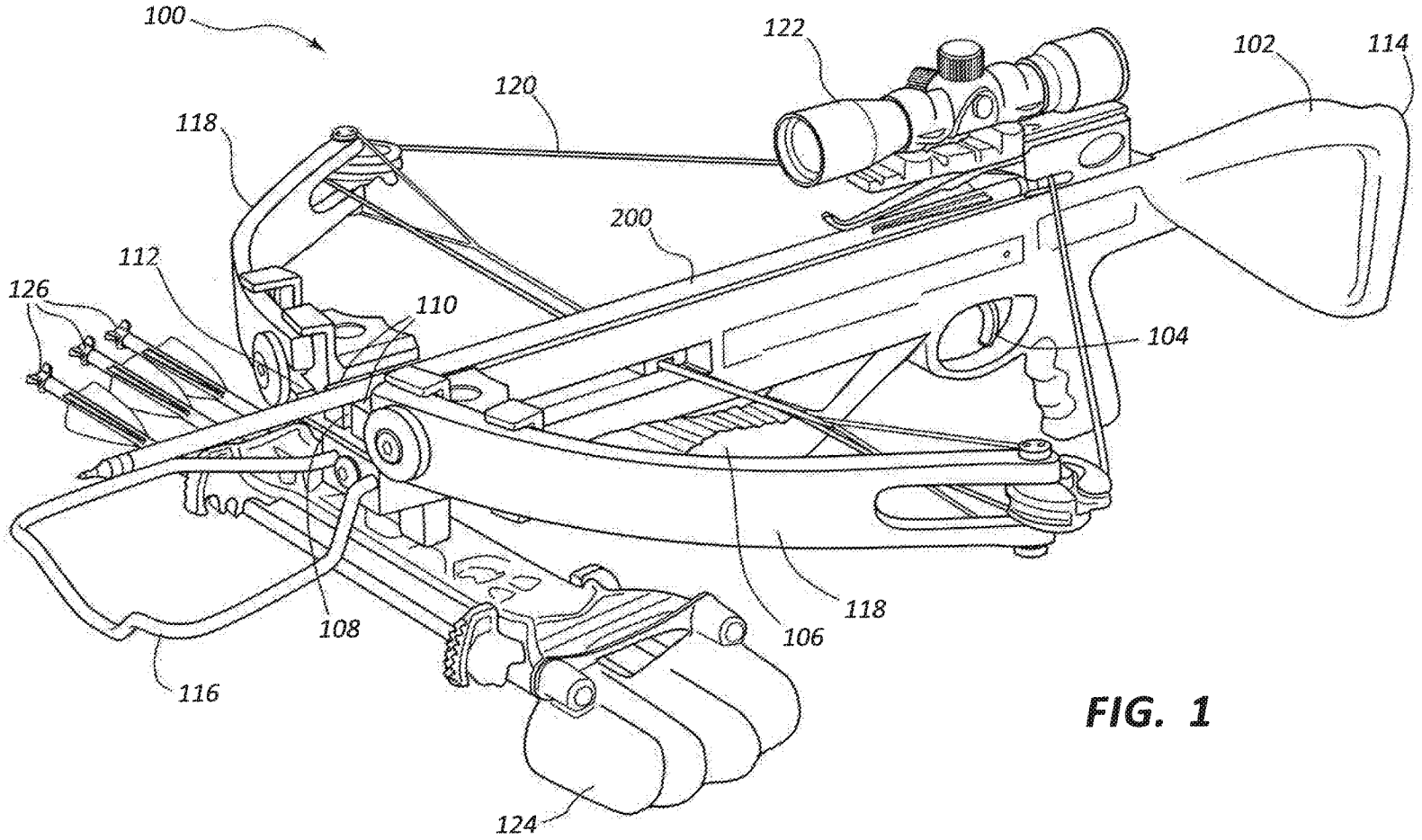
FIG. 1 shows a crossbow according to an embodiment the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to nocks for projectiles used in archery bows and crossbows, but more particularly relates to flocks with lobes for use with crossbows. In an exemplary embodiment, a bow projectile such as, for example, a crossbow bolt or an arrow, may have a nock positioned at its trailing end that has a body portion attached to the shaft of the projectile and one or more lobes radially extending from the body portion at circumferentially spaced apart positions. The positions of the lobes may correspond and align with the vanes or fletchings of the projectile.

The lobes may extend radially away from the longitudinal axis of the body portion and thereby provide a broader rear surface of the nock. Due to having a broader rear surface, there is a broader surface against which the bowstring may contact and there is accordingly a reduced risk of dry fire due to the bowstring slipping past the nock. Additionally, some embodiments may have lobes that at least partially extend around the outer perimeter or circumference of the bowstring When the nock abuts the bowstring so that the bowstring is seated against both the rear surface of the nock and a contoured or curved surface of the lobe. This allows the nock to cradle the bowstring against multiple points on its outer surface, so there is a reduced chance that the bowstring will move relative to the nock when tension in the bowstring is applied to the nock. Additionally, the lobes may contact the bowstring on opposite lateral sides of the projectile (relative to the shaft), so the projectile has improved resistance to axial rotation while shooting.

One or more of the lobes of the nock may also be configured to fit between rails of a crossbow. The lobe may have a width less than or equal to the width of the space between the rails, and thus the lobe may be positioned between the rails to help prevent the projectile from axially rotating relative to the crossbow by mechanical interference between the nock and the rails in addition to the mechanical contact between the lobes and the bowstring. Furthermore, the downward-positioned lobe that is positioned between the rails may provide additional height to the nock, so the nock makes the projectile more resistant to dry fires that involve the bowstring passing under the projectile.

An anti-dry fire (ADF) system is also disclosed herein, wherein the lobe of a nock may be used as a contact surface for an ADF lever or other member. The lobe may extend radially away from the shaft or body portion of a bolt, so when a nock is loaded into the crossbow, the lobe may be the only part of the bolt that comes into contact with the ADF member. If a bolt is loaded without a lobed nock or if a bolt is loaded incorrectly (e.g., without a lobe pointing between the rails), the ADF member is not contacted and the bowstring cannot be released. This is because the ADF member is spaced radially away from the shaft of the bolt and therefore is not actuated or contacted by a conventional bolt shaft or nock that does not have a radially extending lobe. If a bolt with a lobed nock is loaded, however, the ADF member is contacted and the bolt is permitted to fire from the crossbow. As a result, the ADF mechanism may reduce the chance of dry fires related to improperly oriented bolts or dry fires that occur when no bolt or a wrong type of bolt is loaded.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Turning now to the figures in detail, FIG. 1 illustrates a crossbow 100 according to an embodiment of the present disclosure. The crossbow 100 may comprise a stock 102, a trigger assembly 104, a handgrip 106, a flight groove 108, and rails 110 on each side of the flight groove 108. The crossbow 100 may have a front end 112 and a rear end 114. A foot stirrup 116 and a plurality of limbs 118 may be attached at the front end 112. A bowstring 120 may extend across the limbs 118 and may move along the stock 102 adjacent to the rails 110. The crossbow 100 may also comprise sights 122, a quiver 124 to hold extra bolts 126, and other accessories. A bolt 200 is shown loaded on the crossbow 100.

Figure 2:
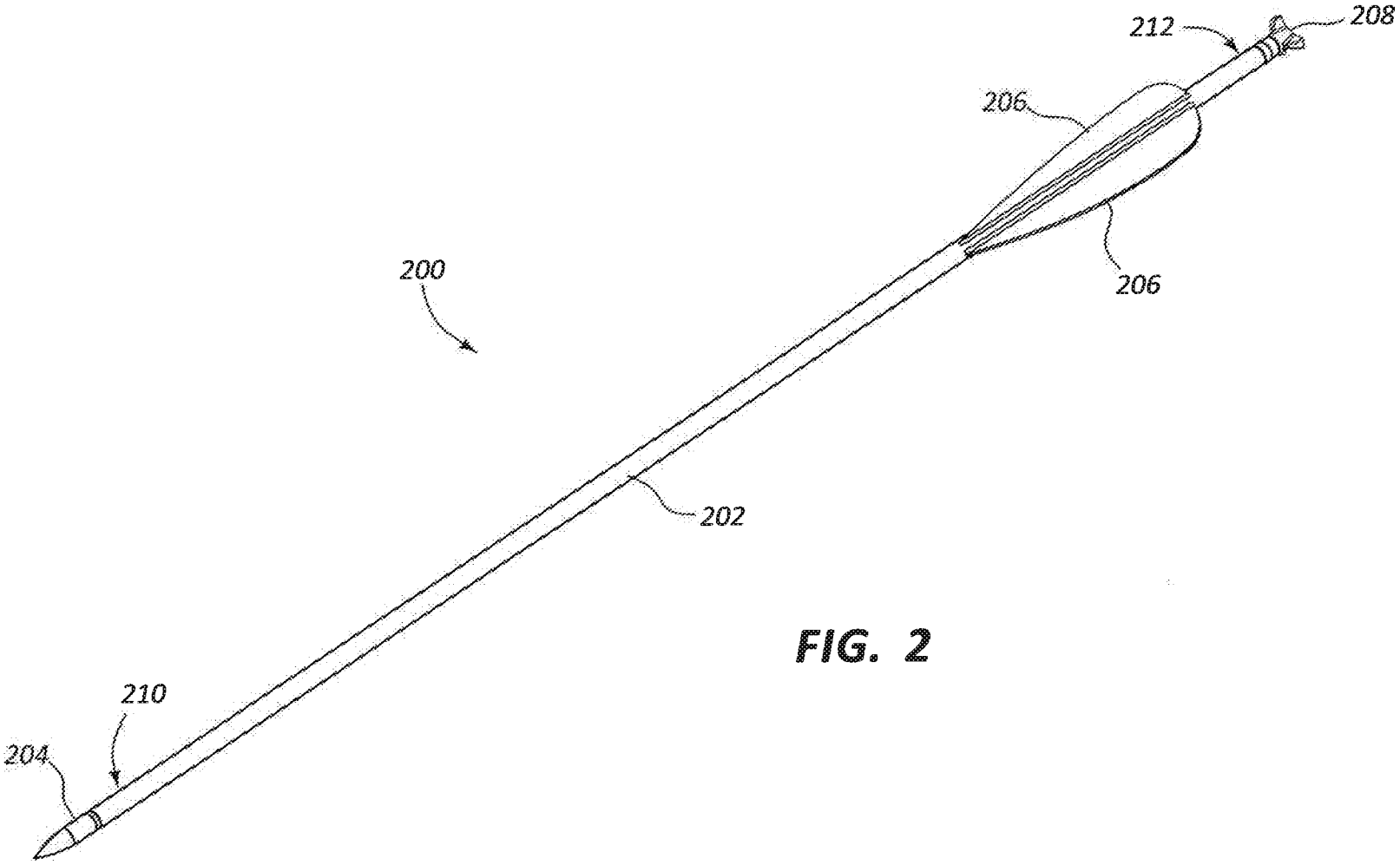
FIG. 2 shows a bolt according to an embodiment of the present disclosure.
Figure 3:
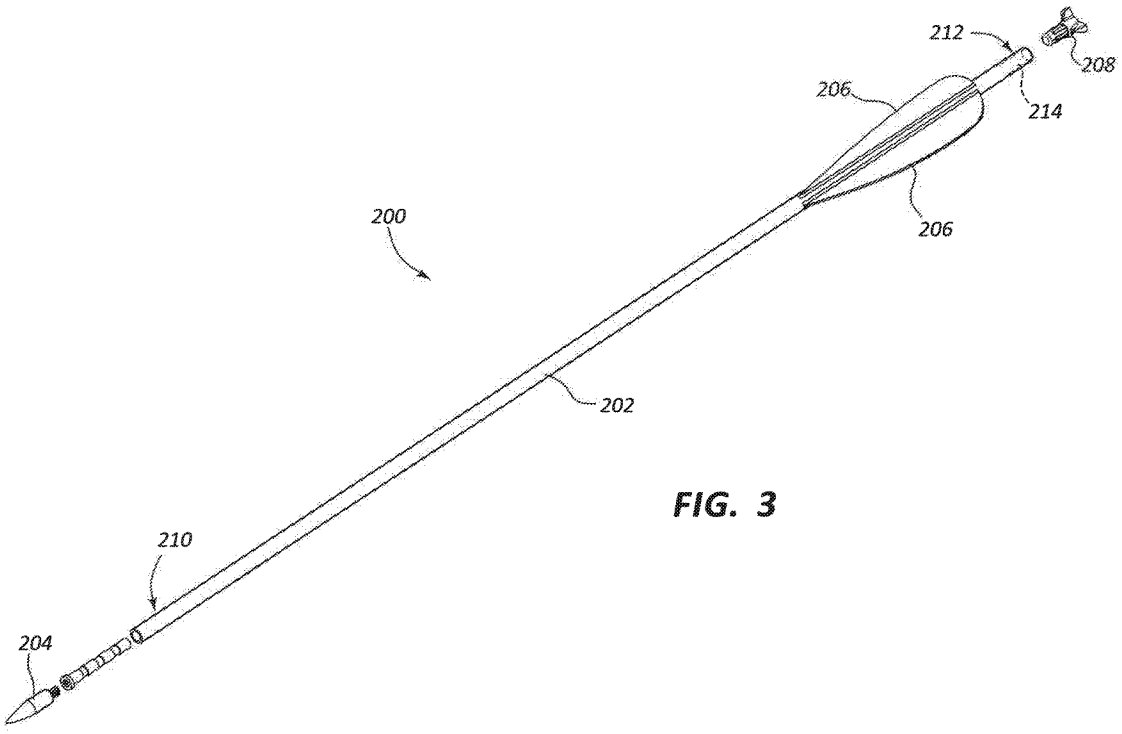
FIG. 3 shows an exploded view of the bolt of FIG. 2.

FIGS. 2 and 3 show a projectile according to an embodiment of the present disclosure. Here, the projectile is a crossbow bolt 200, but it could be an arrow or other comparable projectile. The bolt 200 may comprise an elongated shaft 202, an arrow point 204, a plurality of vanes or fletchings 206, and a nock 208 insertable into an opening 214 in the rear of the shaft 202 (see FIG. 3). A longitudinal axis may extend centrally through the elongated length of the shaft 202. The arrow point 204 may be referred to as being at a front end portion 210 of the shaft 202, and the nock 208 may be referred to as being at a rear end portion 212 of the shaft 202. FIG. 3 illustrates an exploded view of the bolt 200 of FIG. 2, showing that the arrow point 204, vanes 206, and nock 208 may be separate pieces assembled to construct the bolt 200. In other embodiments, the arrow point 204, vanes 206, and/or nock 208 may be integrally formed with the shaft 202 to form a single piece.

Bolts having the nock of the present disclosure may be shot from the crossbow 100 by cocking the crossbow 100 (thereby flexing the limbs 118 rearward where the bowstring 120 is connected to the limbs and positioning the center of the bowstring 120 toward the rear end 114 of the crossbow 100, as shown in FIG. 1), loading a bolt onto the rails 110 with an index vane within the flight groove 108, and pulling the trigger of the trigger assembly 104. The trigger causes the bowstring 120 to be released, thereby allowing the tension in the limbs 118 to forcefully straighten the bowstring 120 and move the center of the bowstring 120 toward the front end 112 of the crossbow 100. This movement of the bowstring 120 causes the bowstring to push the bolt along the rails 110 while it contacts the nock and rapidly launch the bolt forward and off of the crossbow 100.

Embodiments of flocks of the present disclosure may beneficially reduce the chance of a dry fire of the bolt 200 from the crossbow 100 by (1) broadening the rear surface area of the bolt 200 that is configured to contact the bowstring 120 to help keep the bowstring from slipping around the nock and sliding above or below the shaft 202, (2) at least partially extending around the bowstring to keep the nock in contact with the bowstring 120 (even if the bowstring 120 moves vertically to a small degree relative to the nock before or after shooting), (3) reducing the chance that the bolt 200 will be inappropriately loaded on the crossbow 100, and/or (4) interacting with an anti-dry fire (ADF) mechanism.

FIGS. 4A-11E show various embodiments of flocks for projectiles such as bolt 200. Each of these nocks 300, 302,

304, 306, 308, 310, 312, 314 has several features typical to all of the nocks, and these features are shown using common indicator numerals. For example, each nock 300, 302, 304, 306, 308, 310, 312, 314 comprises a body portion 316 having a front end portion 318 and a rear end portion 320. The front end portions 318 are configured to be inserted into the opening 214 at the rear end of the shaft 202 of a bolt 200. Typically, the front end portions 318 fit within the opening 214 using a friction or resilient snap fit that makes the front end portions 318 resist rotation relative to the shaft 202 or withdrawal from the opening 214. Thus, once inserted into the shaft 202, the front end portions 318 may remain secured to the shaft 202 under normal use during transportation and shooting the bolt 200. In some configurations, the entire front end portion 318 may be received within the shaft 202, and in other configurations, the front end portion 318 may only be inserted partially therein. In some embodiments, a front end portion 318 may also be removable from the shaft 202 when sufficient force is applied to pull the front end portion 318 out of the opening 214. In order to facilitate the fit of the front end portion 318 in the shaft 202, the front end portion 318 may comprise a plurality of circumferentially spaced ridges 322 that can be compressible into the opening 214. In some embodiments, the front end portion 318 may be smooth and without ridges 322. The front end portion 318 may also be hollowed out or formed with a hollow longitudinal chamber 324 to reduce weight and material costs of the nocks 300, 302, 304, 306, 308, 310, 312, 314. In some embodiments the front end portions 318 may be secured to a shaft 202 using an adhesive, fastener, or other connection method known in the art.

The rear end portions 320 of the nocks of FIGS. 4A-11E each comprise three lobes which each have different features that will be described in detail below in connection with each embodiment individually. Each of the lobes may be sized with a different width W (see FIG. 4D) configured to fit between the rails 110 and within the flight groove 108 of the crossbow 100. Typically, the width W is less than the distance between the rails 110 so that the bolt 200 can slide freely along the groove 108 while the lobe is between the rails 110. Some embodiments, discussed below, may have a width that tapers between the body of the nock and the radially external tip of the lobe. In those cases, the width W may be defined as the width of the lobe that is either at the base of the lobe or at the radial position on the lobe that aligns with the top of the rails 110 of the crossbow 100 when the bolt 200 is loaded. See, e.g., width W in FIG. 5D, showing the width of lobe 500 at the top of rails 110. The width W of the lobes may also be configured to reduce rattling or rotation of the bolt 200 relative to the rails 110 due to the lobe being close to the width of the flight groove 108.

Each of the lobes of the rear end portions 320 may have equal widths W, so any of the three lobes may be configured to point downward between the rails 110 of a crossbow 100. The vane or fletching of the bolt 200 that lies between the rails 110 is conventionally referred to as the index vane, so any of the three lobes may be referred to as an "index lobe" of the nock. Because any of the three lobes may be the index lobe, a bolt 200 having one of the nocks of the present disclosure may be loaded in multiple orientations while still allowing the nock to retain the bowstring 120 in each orientation. By comparison, conventional bolts are only configurable with one vane extending downward as an index vane, so the bolts only have one nocked position.

In other embodiments, the lobes of the rear end portions 320 may not all have equal widths. For example, a nock may comprise lobes wherein one of the lobes is narrower than the other lobes. The narrower lobe may be narrow enough to fit between the rails 110, and the other lobes may be too wide to fit. Thus, in this manner the lobes may provide a "go/no-go" design wherein the bolt 200 clearly indicates to the user whether it is loaded properly since the lobe pointing downward on the bolt 200 will either fit between the rails and slide into place easily or the lobe will not fit between the rails and the bowstring 140 may visibly not align with the bolt 200 or the bolt 200 may be impossible to move into the loaded position due to interference of the nock with other parts of the crossbow.

The nocks of FIGS. 4A-11E are pictured with two lobes appearing on the bottom half of the nock body and one lobe appearing on the top half. However, it will be understood by those having skill in the art and by reference to FIGS. 12A-12K that when these flocks 300, 302, 304, 306, 308, 310, 312, 314 are used with a bolt 200 in a crossbow 100, one lobe will be pointing downward and the other two lobes will extend diagonally upward relative to the nock body and relative to the shaft 202 of the bolt. This orientation is shown, for example, in FIGS. 5A-5D. Thus, the pictured nocks may be turned over relative to FIGS. 4A-4D and 6A-11E when they are loaded into a crossbow 100. Typically, the lobes are arranged at 120 degrees of radial symmetry, but other arrangements may be used as well.

Figure 4A:
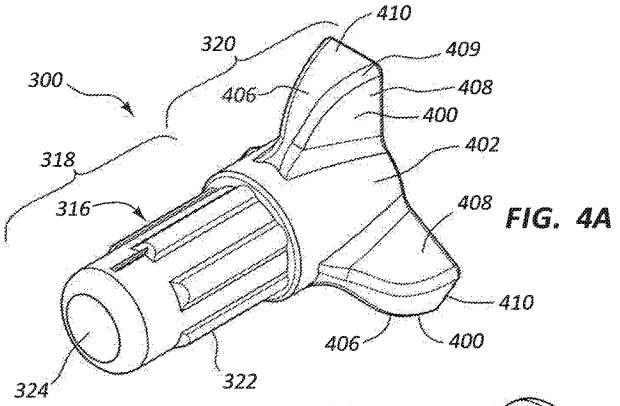
FIG. 4A shows a front perspective view of a nock according to an embodiment of the present disclosure.
Figure 4B:
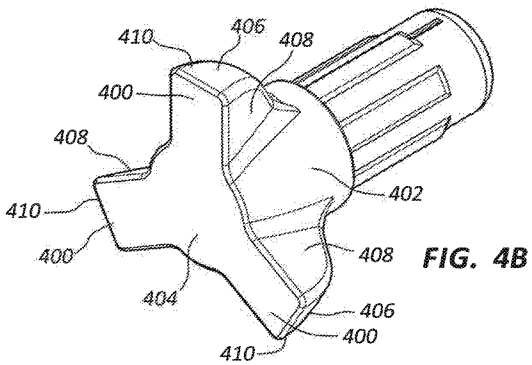
FIG. 4B shows a rear perspective view of the nock of FIG. 4A.
Figure 4C:
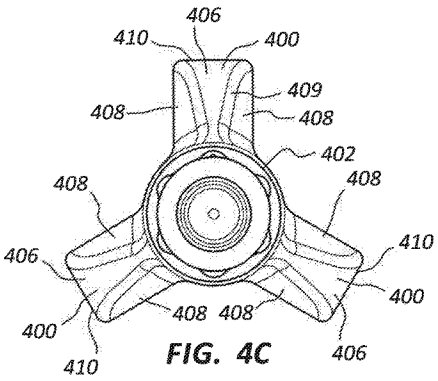
FIG. 4C is a front view of the nock of FIG. 4A.
Figure 4D:
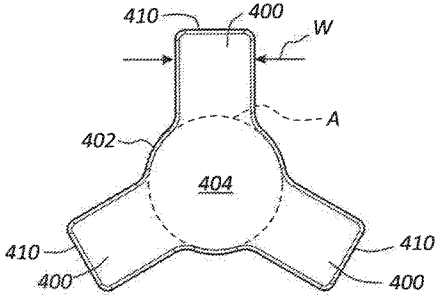
FIG. 4D is a rear view of the nock of FIG. 4A.
Figure 5A:
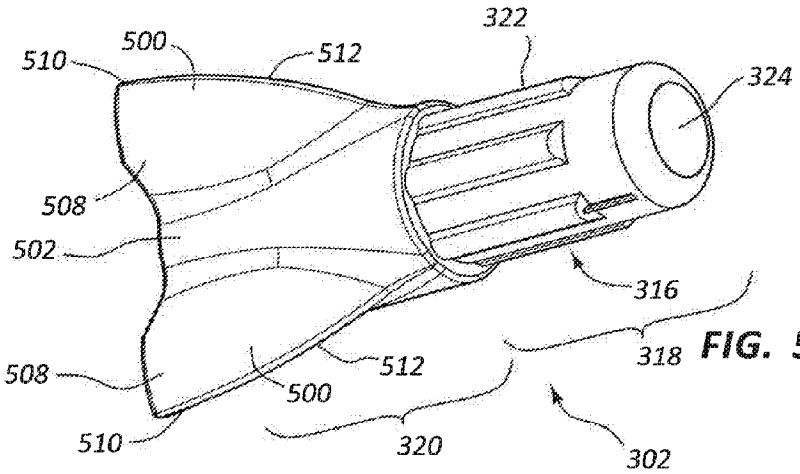
FIG. 5A shows a front perspective view of a nock according to an embodiment of the present disclosure.
Figure 5B:
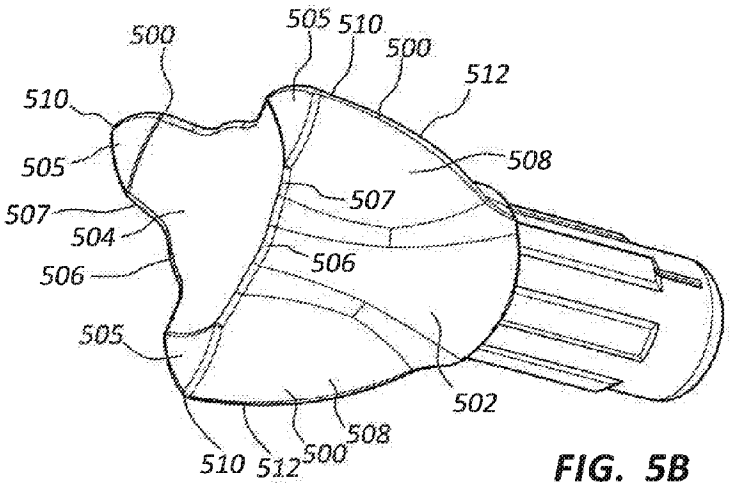
FIG. 5B shows a rear perspective view of the nock of FIG. 5A.
Figure 5C:
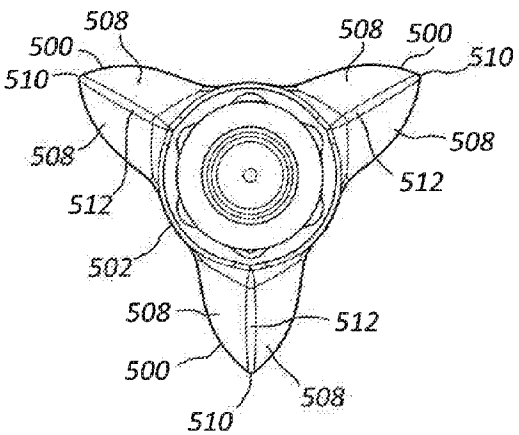
FIG. 5C is a front view of the nock of FIG. 5A.
Figure 5D:
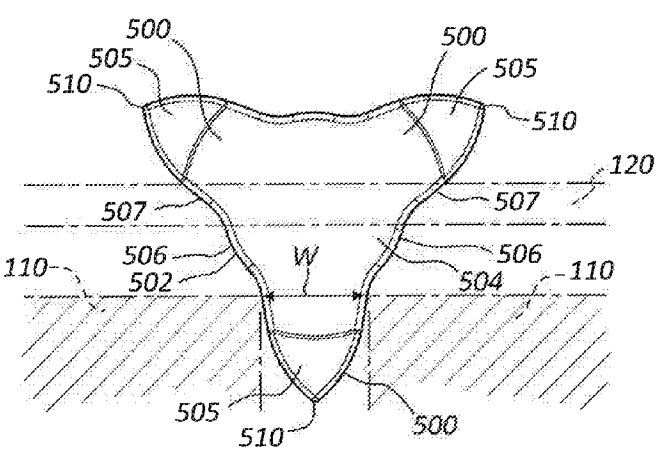
FIG. 5D is a rear view of the nock of FIG. 5A shown relative to a set of crossbow rails and a bowstring.
Figure 6A:
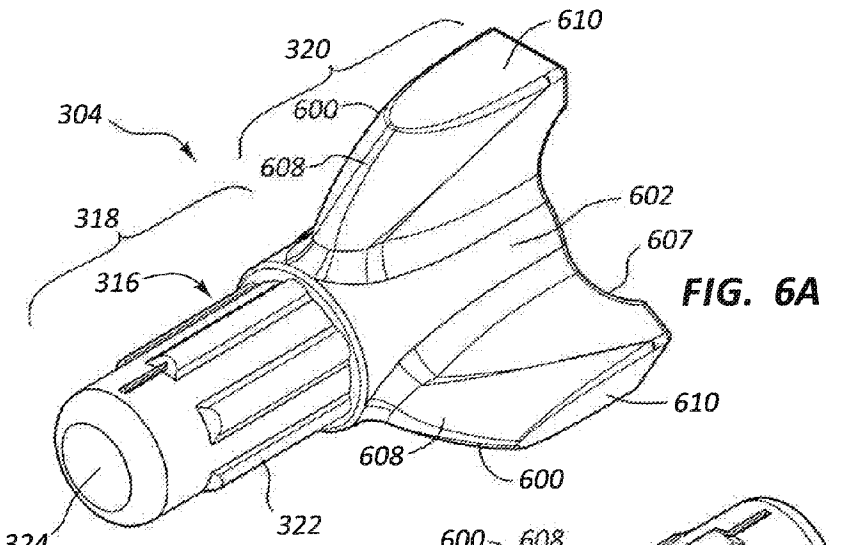
FIG. 6A shows a front perspective view of a neck according to an embodiment of the present disclosure.
Figure 6B:
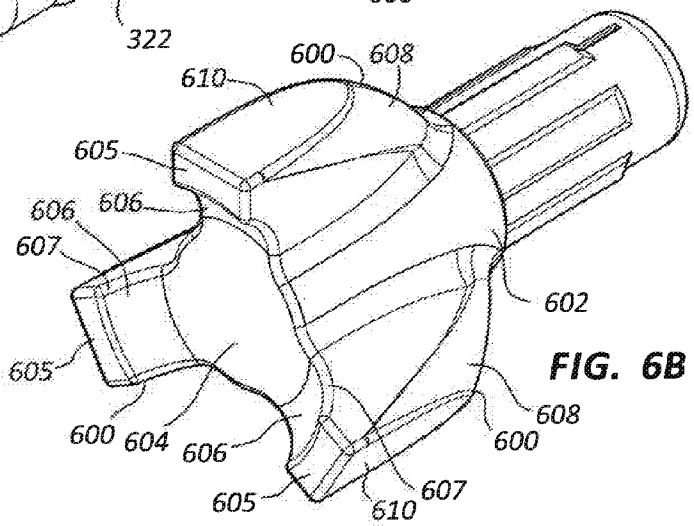
FIG. 6B shows a rear perspective view of the nock of FIG. 6A.
Figure 6C:
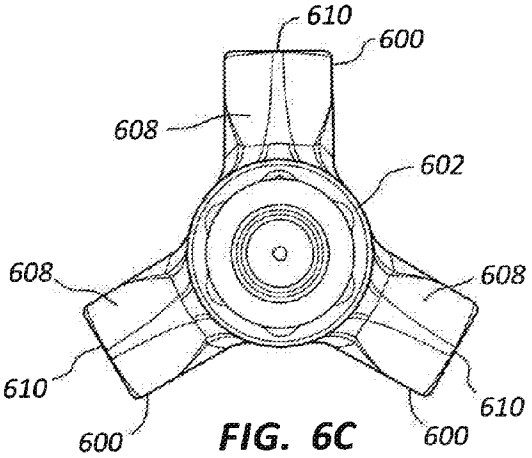
FIG. 6C is a front view of the nock of FIG. 6A.
Figure 6D:
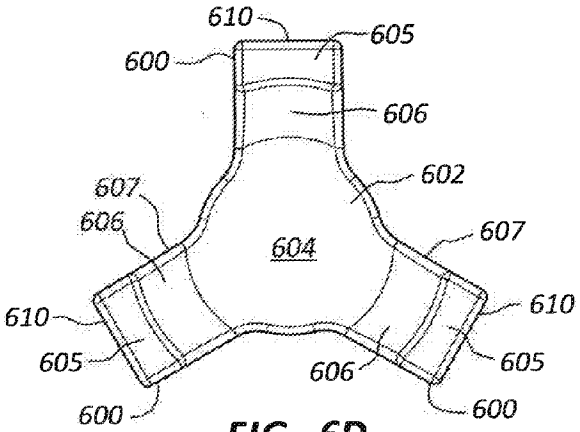
FIG. 6D is a rear view of the nock of FIG. 6A.
Figure 7A:
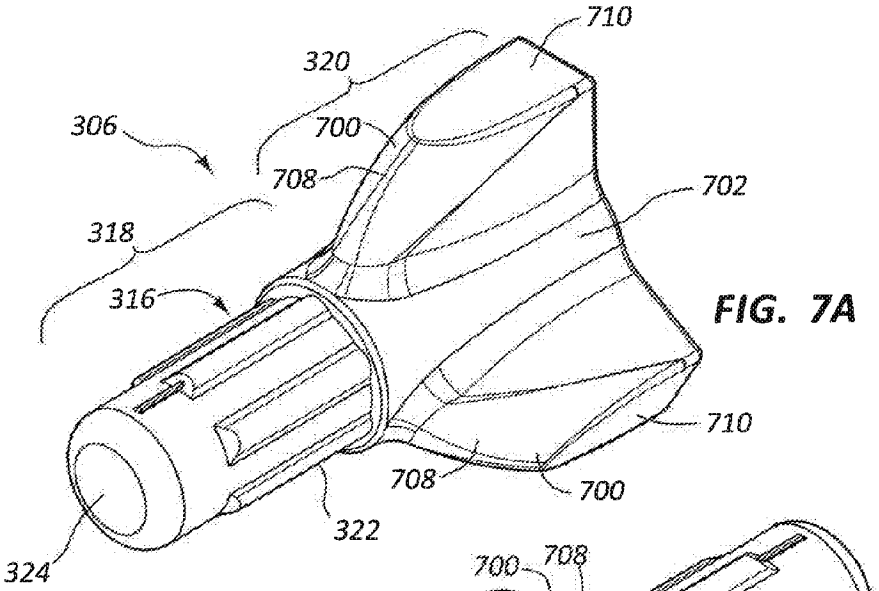
FIG. 7A shows a front perspective view of a neck according to an embodiment of the present disclosure.
Figure 7B:
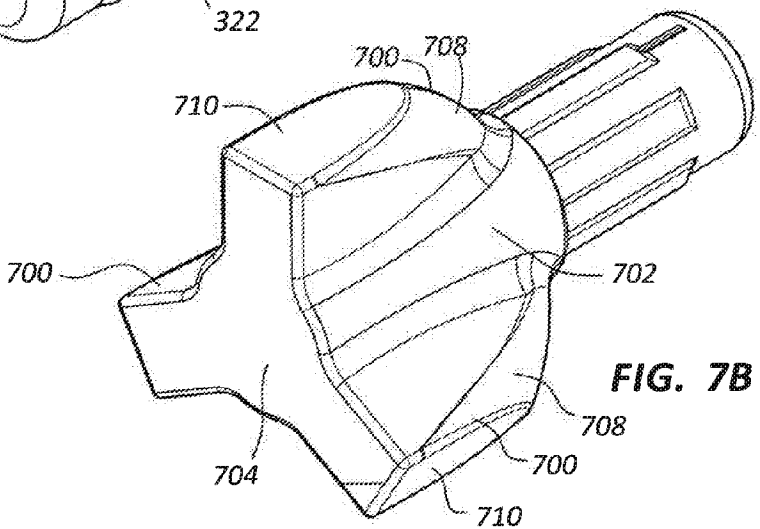
FIG. 7B shows a rear perspective view of the nock of FIG. 7A.
Figure 7C:
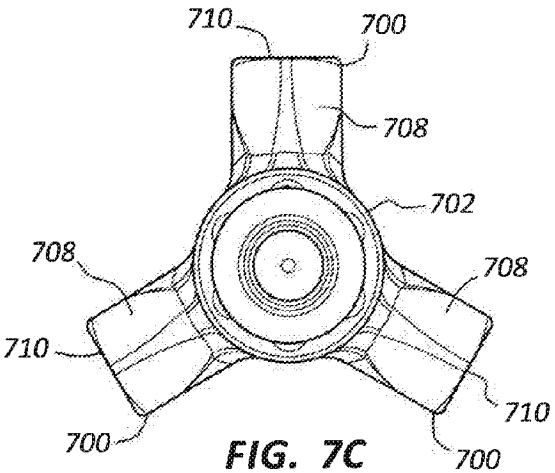
FIG. 7C is a front view of the nock of FIG. 7A.
Figure 7D:
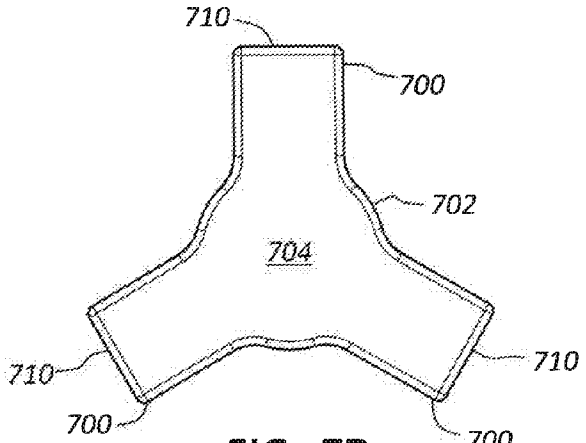
FIG. 7D is a rear view of the nock of FIG. 7A.

Referring now to the nocks of FIGS. 4A-11E individually, FIGS. 4A-4D show an embodiment of a nock 300 wherein the lobes 400 each extend peripherally from a body portion 402 of the rear end portion 320 of the nock 300. The lobes 400 and body portion 402 collectively form a flat rear surface 404. The flat rear surface 404 has a surface area greater than the surface area of the rear of a shaft 202 of the bolt 200 to which the nock 300 is attached. FIG. 4D indicates the perimeter of the rear profile A of the shaft 202 in broken lines for comparison with the rear surface 404 of the nock 300.

The flat rear surface 404 has a greater width and height than the rear profile A of the shaft 202. This means that when the bowstring 120 is positioned behind the rear surface 404, the bowstring 120 would need to vertically slip significantly farther from the longitudinal axis of the bolt 200 in order to slip around the lobes 400 than a traditional nock (e.g., a "flatback" nock) that has a width and height substantially equal to the rear profile A of the shaft 202. Each of the nocks 302, 304, 306, 308, 310, 312, 314 described below also have a rear profile that is wider and taller than the rear profile A of the shaft 202.

The lobes 400 also each have a front surface 406 and two side surfaces 408. The front surface 406 is broadest at the rear surface 404 and narrows as it extends forward along the rear end portion 320 of the nock 300. This shape improves the aerodynamic properties of the nock 300 and may make it easier for the user to slide the lobes 400 between the rails 110 of the crossbow 100.

The lobes 400 also each have a tip surface 410 that is at the outermost radial distance from the longitudinal axis of the nock 300. The tip surface 410 may be substantially flat. The tip surface 410 may be used as a contact surface for the anti-dry fire mechanism described below in connection with FIGS. 12A-12K.

In some embodiments, the lobes 400 may be of a size and configuration to function as vanes for the bolt 200. Thus, in some cases there may be no need for vanes 206, but rather the lobes 400 themselves may be sized and configured sufficient to function as vanes to stabilize the bolt 200. The lobes 400 and rear end portion 320 of the nock 300 may be enlarged and/or elongated for this purpose. In such eases, the distal-most end of the bolt 200 (including the nock 300) may coincide with and be equivalently axially positioned as the distal ends of the lobes (e.g., 404 in FIG. 4B or 505 in FIG. 5B). Similarly, the lobe may have a highest profile point or highest radial distance from the lobe body portion (e.g., 402), which may coincide with the distal-most end of the bolt 200. For example, the tip surface 410 of neck 300, which has the highest profile location/point or highest radial distance from the body portion 402 may coincide with the distal-most end of the bolt 200 to which the nock 300 is installed. In this case, the distal-most end would be the same as the rear surface 404, and surface 410 is located at substantially the same axial position as rear surface 404.

FIGS. 5A-5D show another embodiment of a nock 302 having lobes 500 and a body portion 502. This nock 302 may have a concave rear surface 504 (see the recessed rear surfaces 504 in FIGS. 5B and 5D) and a plurality of fiat rear surfaces 505. When the bolt 200 having nock 302 is loaded onto the crossbow 100, the bowstring 120 may contact the outer edges of the concave rear surface 504 in the general position of the bowstring 120 in FIG. 5D. Thus, the bowstring 120 may contact the edges 506 of the body portion 502 and the edges 507 of two of the lobes 500 that are not being used as the index lobe. Because only the edges 506, 507 are in contact with the bowstring 120, the bowstring 120 may be less likely to slide relative to the nock 302 while they remain in contact with each other. The curvature of these edges 507 may form a cylindrical bowstring contact surface, meaning they follow a cylindrical profile or may curve in a manner following the curvature of a cylindrical bowstring surface.

When the bolt 200 is loaded, the flat rear surfaces 505 may be positioned rearward relative to the front-most surface of the bowstring 120 (e.g., the surface that contacts the nock 302). See also FIGS. 10E, 12F, and 12I. Thus, the bowstring 120 may contact the edges 507 of the lobes 500 and may be held behind the nock 302 so that there is minimal vertical movement of the bowstring 120 relative to the rear surface 504.

The lobes 500 of nock 302 may have side surfaces 508 that radially taper from the body portion 502 up to the radial tips 510 of the lobes 500. Thus, the side surfaces 508 may be convex and may meet each other along a curved longitudinally-oriented edge 512. These lobes 500 may therefore have a smoother aerodynamic profile and use less material than the lobes 400 of FIGS. 4A-4D. The longitudinally-oriented edge 512 may also be used as a contact surface for the anti-dry fire mechanism of FIGS. 12A-12K.

FIGS. 6A-6D show another embodiment of a nock 304 with lobes 600 and a body portion 602. The rear surface 604 of the body portion 602 is flat, and the rear surfaces 605 of each of the lobes 600 are partially flat as well. Lofted, curved surfaces 606 on the rear of the nock 302 may connect the rear surface 604 of the body portion 602 to the flat rear surfaces 605 of the lobes 600. When a bolt 200 with nock 304 is loaded next to a bowstring 120, the bowstring 120 may extend into contact with the rear surface 604 of the body portion 602 and the edges 607 of the lofted, curved surfaces 606 on the lobes 600 that are not being used as the index lobe. Thus, the curvature of the lofted, curved surfaces 606 may be substantially a reverse of the outer curvature of the bowstring 120 that will be used with the nock 304 so that the outer surface of the bowstring 120 is cradled or captured by the curvature of the edges 607 when contacting the nock 304. This may help provide a secure hold between the nock 304 and the bowstring 120 throughout a bolt launch process. In these embodiments, the bowstring may only be cradled by the curvature of the nock on a top side of the bowstring.

The lobes 600 also each comprise a flat outer surface 610 that faces radially away from the body portion 602. These outer surfaces 610 may be used as a contact surface for the anti-dry fire mechanism of FIGS. 12A-12K. The lobes 600 may also have a smoothly curved front surface 608 that improves aerodynamics of the nock 304.

FIGS. 7A-7D show yet another embodiment of a nock 306 having lobes 700 and a body portion 702. In this embodiment, the rear surface 704 of the lobes 700 and body portion 702 is entirely flat, similar to the embodiment shown in FIGS. 4A-4D. In this embodiment, however, the lobes 700 each have a flat outer surface 710 facing radially away from the body portion 702. These outer surfaces 710 are similar to, and may serve the same purposes as, the outer surfaces 610 of nock 304. The lobes 700 also have front surfaces 708 that are similar to, and may serve the same purposes as, the front surfaces 608 of nock 304.

FIGS. 8A-8D show another embodiment of a nock 308 having lobes 800 extending from a body portion 802. Here the rear surface 804 of the body portion 802 is flat and the rear surfaces 806 of the lobes 800 are curved. The rear surfaces 806 may be described as being concave. The lobes 800 may each also have outer surfaces 810 comparable in shape and function to the other outer surfaces 610, 710 and front surfaces 808 comparable in shape and function to the other front surfaces 608, 708 described previously herein. This nock 308 may have a reduced rear surface area, width, and height compared to nock 304 which may make nock 308 lighter and more aerodynamic than nock 304. The reduced radial length of the lobes 800 may also help the lobes 800 fit within a loading slot of a crossbow 100 more readily than other embodiments that have greater width and height.

Figure 8A:
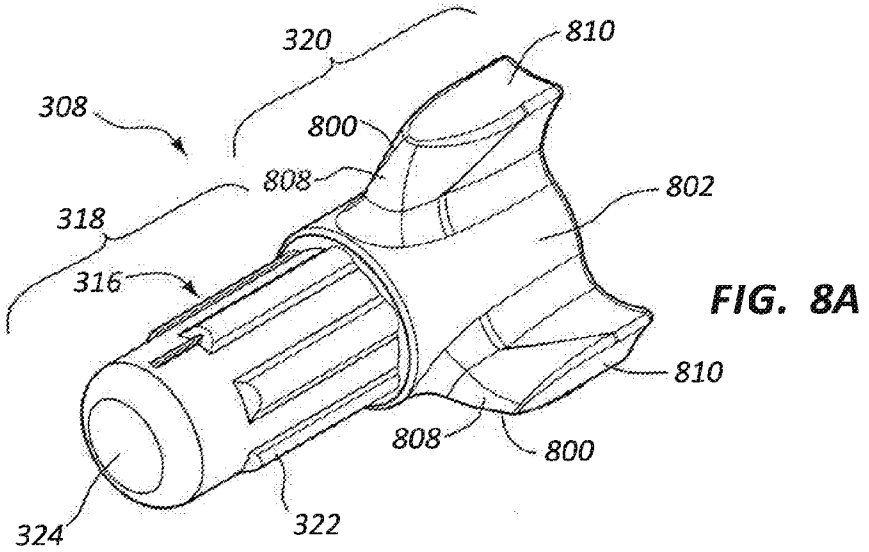
FIG. 8A shows a front perspective view of a nock according to an embodiment of the present disclosure.
Figure 8B:
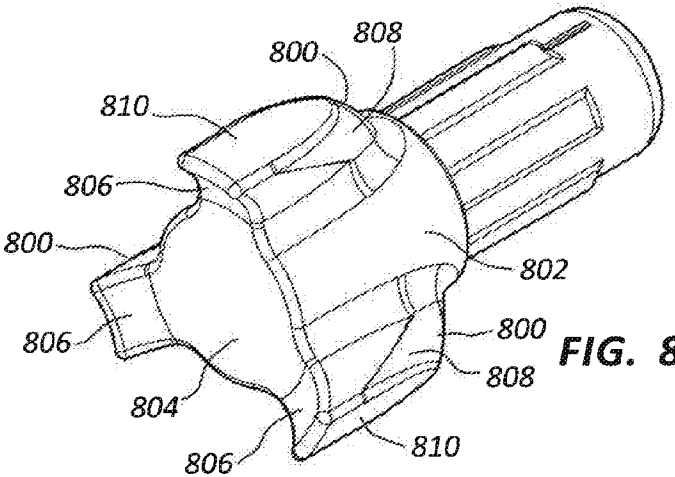
FIG. 8B shows a rear perspective view of the nock of FIG, 8A.
Figure 8C:
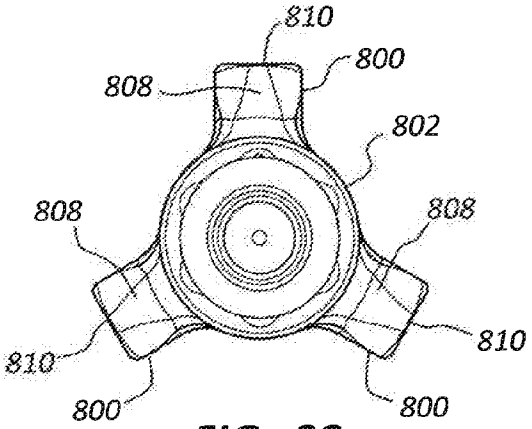
FIG. 8C is a front view of the nock of FIG. 8A.
Figure 8D:
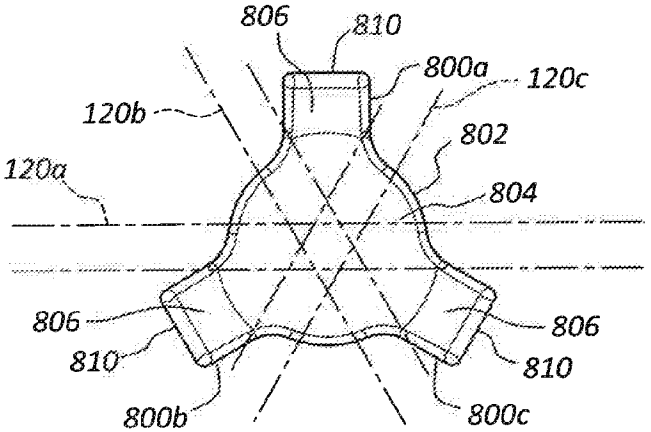
FIG. 8D is a rear view of the nock of FIG. 8A and is shown relative to a plurality of bowstring positions.

FIG. 8D shows a plurality of bowstrings 120*a*, 120*b*, 120*c* oriented in different positions relative to the nock 308. Each of the bowstrings 120*a*, 120*b*, 120*c* represents a different way that a bowstring may contact the rear of the nock 308 while still allowing one of the lobes 800 to be an index lobe. For example, when a bowstring is positioned in the same position as bowstring 120*a*, lobe 800*a* may be the index lobe positioned pointing downward into a flight groove 108. Likewise, when the bowstring is positioned as bowstrings 120*b* or 120*c*, respective lobes 800*b* or 800*c* may be the index lobe positioned in the flight groove 108. In this manner, there are at least three possible bowstring orientations usable with the nock 308. Each of these three orientations have longitudinal bowstring seat axes that form a triangle in a plane perpendicular to the longitudinal axis of the nock 308 (i.e., as indicated by the bowstrings 120*a*, 120*b*, 120*c* in FIG. 8D). The plurality of bowstring positions shown in FIG. 8D is possible in each of the flocks of FIGS. 4A-11E. Thus, each of them provide at least three different bowstring orientations.

FIG. 8D also shows that the lobes 800 not used as the index lobe may contact the bowstring on opposite lateral sides of the projectile (relative to the shaft). For example, if the bowstring is positioned as bowstring 120*a*, lobe 800*a* is the index lobe and lobes 800*b*, 800*c* are positioned on opposite lateral sides of the body portion 802 and the shaft 202 of the bolt 200 to which the nock 308 is attached. Because the lobes 800*b*, 800*c* abut the bowstring 120*a* on opposite sides of the shaft, the nock 308 helps prevent axial rotation of the bolt 200 before it separates from the bowstring 120*a*. The lobes 800*b*, 800*e* may extend laterally relative to a vertical direction (e.g., at least partially to the left and to the right relative to the vertical direction) when the index lobe 800*a* extends along the vertical direction. For example, when lobe 800*a* is used as the index lobe and is positioned vertically between rails of a crossbow, the other two lobes 800*b*, 800*c* may extend at least partially laterally to the left and right of that vertical direction.

FIGS. 9A-9D show another embodiment of a nock 310 with lobes 900 extending from body portion 902. This nock 310 also has a flat rear surface 904 for the body portion 902 and curved rear surfaces 906 for each of the lobes 900. The lobes 900 in this embodiment have a radially-extending T-shape or cross-shape wherein a head portion 912 of each lobe 900 is linked to the body portion 902 of the nock 310 by a neck portion 914. See FIG. 9D. The head portion 912 of each lobe 900 may be broader than the neck portion 914 in a direction tangent to the outer surface of the body portion 902 or tangent to the outer surface of the shaft 202 of the bolt 200. In other words, the head portions 912 may be broadened relative to the neck portions 914 in a direction perpendicular to a radial direction that extends from the longitudinal axis of the body portion 902. Each lobe 900 therefore has an outer surface 910 facing radially away from the body portion 902 and at least one inner surface 916 facing radially inward toward the body portion 902. The inner surfaces 916 may be referred to as retaining surfaces. The outer surfaces 910 may be at least partially flat and may be used as a contact surface in connection with an anti-dry fire mechanism, as described in further detail below in connection with FIGS. 12A-12K.

Figure 9A:
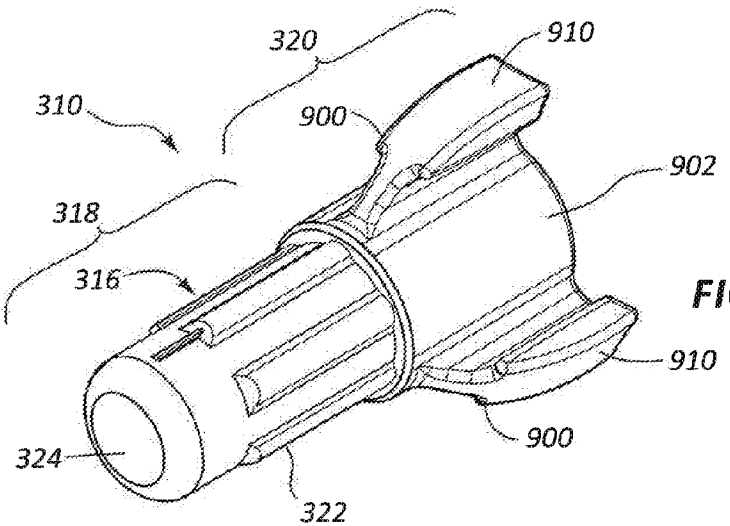
FIG. 9A shows a front perspective view of a nock according to an embodiment of the present disclosure.
Figure 9B:
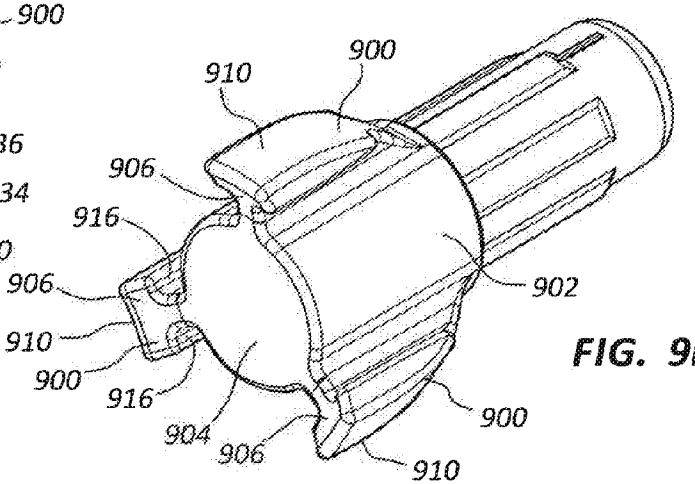
FIG. 9B shows a rear perspective view of the nock of FIG. 9A.
Figure 9C:
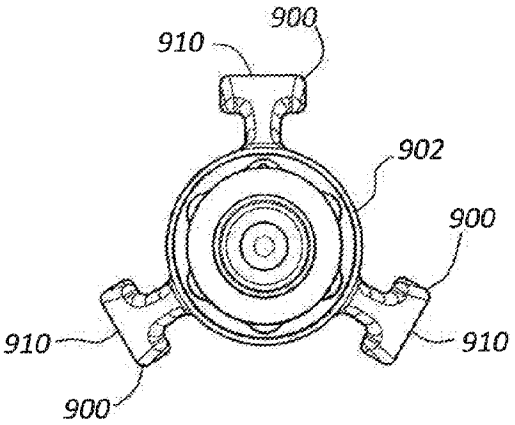
FIG. 9C is a front view of the nock of FIG. 9A.
Figure 9E:
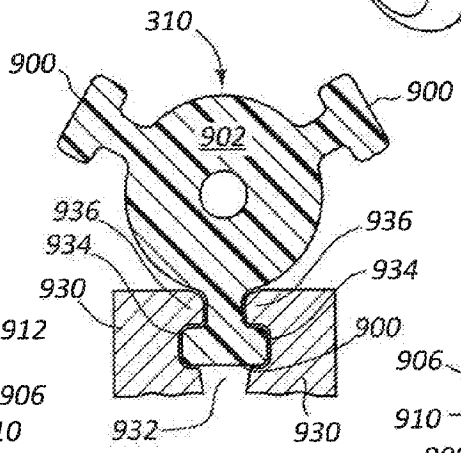
FIG. 9E shows a rear profile cross-section of the nock of FIG. 9A relative to a set of crossbow rails.
Figure 9D:
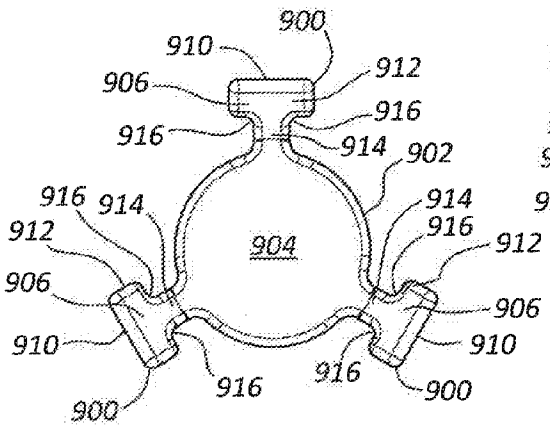
FIG. 9D is a rear view of the nock of FIG. 9A.

The spaces between the inner surfaces 916 and the body portion 902 may be configured to receive ridges 936 of the rails 930 of a crossbow 100. FIG. 9E shows an example embodiment wherein a T-shaped lobe 900 is positioned between rails 930 with a keyway groove 932 extending therebetween. The keyway groove 932 may have notches or grooves 934 in which the lobe 900 is seated and may have ridges 936 that fit between the body portion 902 and the inner surfaces 902 of the nock 310. In this manner, the rails 930 may be configured to interlock with the rails 110. By receiving the lobes 900 in a keyway groove 932, the nock 310 may help prevent the bolt 200 from moving vertically away from the rails 930 before or during launch.

In the embodiment of FIGS. 9A-9D, the head portion 912 of each lobe 900 is spaced away from the body portion 902 by the neck portion 914 at the rear of the nock 310 and connects to the body portion 902 at a more forward position on the body portion 902. See FIGS. 9A-9B. In other cases, the head portion 912 may be spaced away by a neck portion at the front end of the head portion 912 as well.

FIGS. 10A-10E show another nock 312 with lobes 1000 that extend from a body portion 1002. This nock 312 is comparable to nock 302 in many ways, but has smaller lobes 1000 that decrease the height and weight of the nock 312 and may help the nock 312 more easily fit into the proximal end of a crossbow 100. The rear surface 1004 of the body portion 1002 is also flat, unlike the concave rear surface 504 of neck 302. The lobes 1000 each have an outer ridge 1010 that runs longitudinally along their front and outer surfaces. As described in further detail below, the outer ridges 1010 may be used as contact surfaces for the anti-dry fire mechanism of FIGS. 12A-12K.

Figures 10A, 10B, 10C, 10D, 10E:
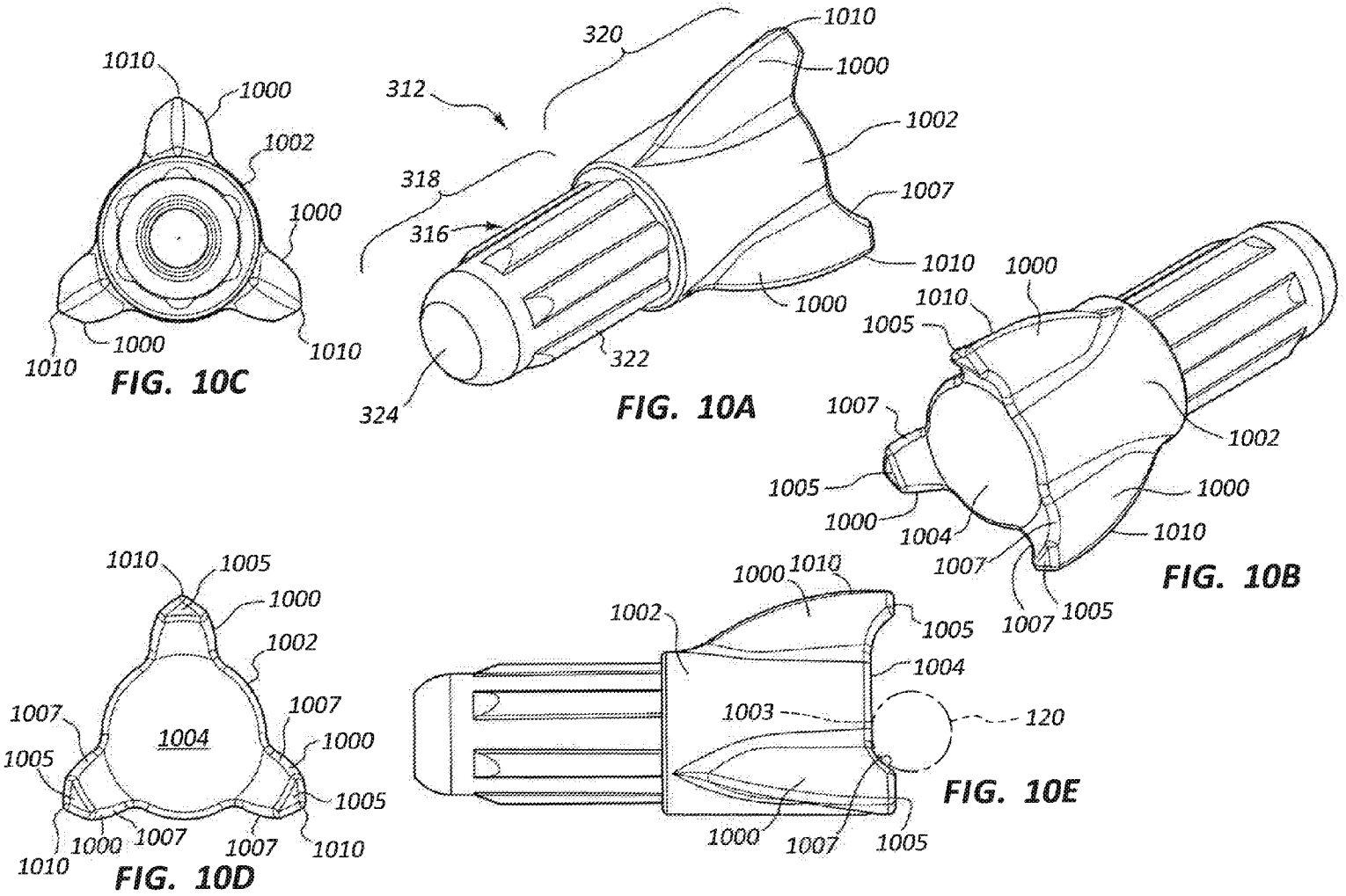
FIG. 10A shows a front perspective view of a nock according to an embodiment of the present disclosure.
FIG. 10B shows a rear perspective view of the nock of FIG. 10A.
FIG. 10C is a front view of the nock of FIG. 10A.
FIG. 10D is a rear view of the nock of FIG. 10A.
FIG. 10E is a side view of the nock of FIG. 10A and shown relative to a bowstring.
Figure 11A:
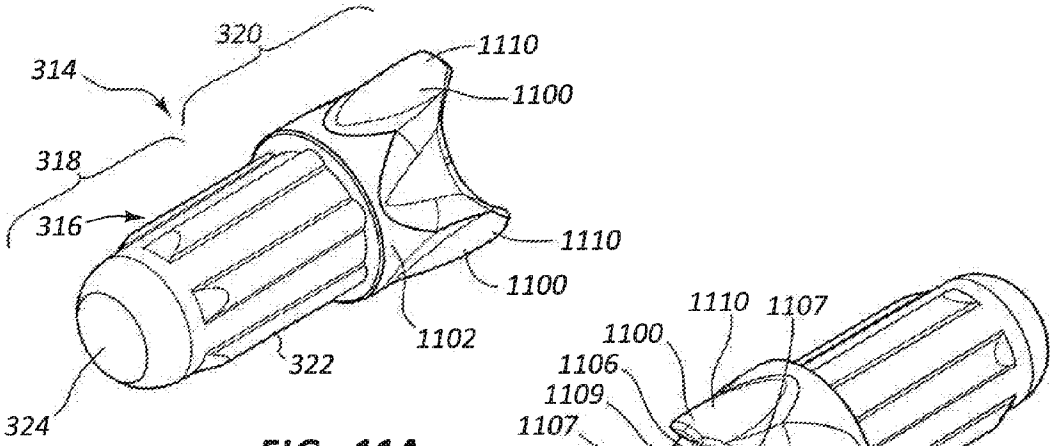
FIG. 11A shows a front perspective view of a nock according to an embodiment of the present disclosure.
Figure 11B:
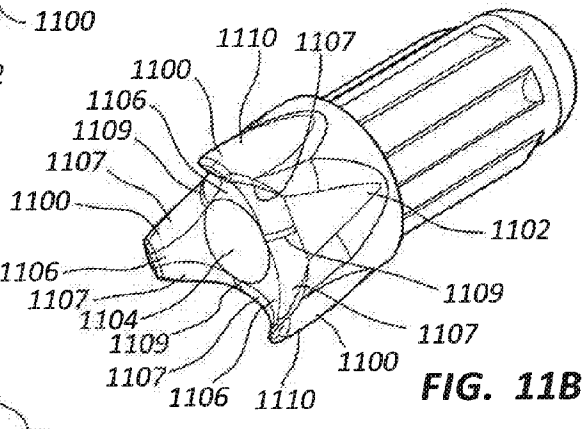
FIG. 11B shows a rear perspective view of the nock of FIG. 11A.
Figure 11E:
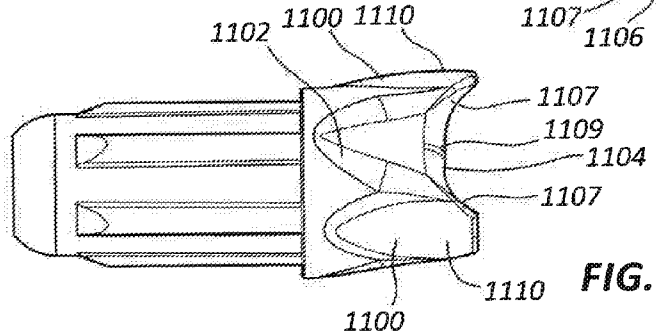
FIG. 11E is a side view of the nock of FIG. 11A.
Figure 11C:
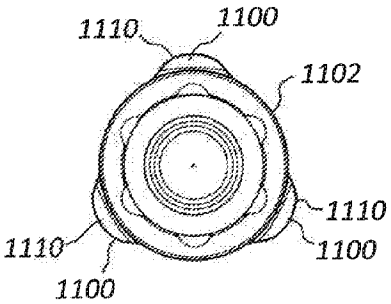
FIG. 11C is a front view of the nock of FIG. 11A.
Figure 11D:
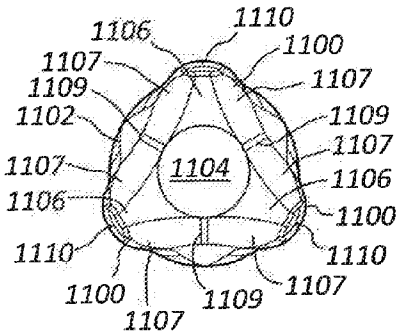
FIG. 11D is a rear view of the nock of FIG. 11A.

FIG. 10E in particular shows a side view of the neck 312 showing an exemplary placement of a bowstring 120 relative to the nock 312 when the nock 312 is loaded onto a crossbow 100. This view shows, for example, how the bowstring 120 may contact edges 1007 of the lobes 1000 and the flat rear surface 1004 simultaneously and how the front surface 1003 of the bowstring 120 may be positioned further forward than the rear surfaces 1005 of the lobes 1000. A bowstring 120 may be comparably positioned adjacent the other flocks disclosed herein.

FIGS. 11A-11E show yet another nock 314 for a bolt 200 that has three lobes 1100 extending circumferentially spaced around a body portion 1102. The lobes 1100 of this nock 314 extend radially away from the body portion 1102 to a lesser distance than previous embodiments described herein, thereby improving aerodynamics of the nock 314 and making it have a smaller profile that can more easily be loaded between proximal slots of a typical crossbow 100. The smaller lobes 1100 may also allow the nock 314 to be used with a wider variety of bolts 200, such as, for example, bolts with short vanes. Smaller lobes 1100 also may decrease friction against the rails 110 or flight groove 108 of a crossbow 100.

The lobes 1100 extend rearward from a flat rear surface 1104 of the body portion 1102 and they have curved surfaces 1106 that are linked to the flat rear surface 1104. The outer surfaces 1110 of the lobes 1100 are curved but may be used as contact surfaces for the anti-dry fire mechanism of FIGS. 12A-12K. The outer surfaces 1110 are also notable for being smooth and without any sharp edges (e.g., the edge of radial tip 510 of nock 302) or ridges (e.g., the edge 409 between the front surface 406 and side surface 408 of nock 300).

Nock 314 also has rounded rear edges 1107, 1109 that have higher curvature than the rear edges of other nock embodiments shown herein. The higher curvature may make the lobes 1100 more resistant to chipping or manufacturing flaws and may reduce the overall amount of material needed to construct the nock 314. The higher curvature may also allow the nock 314 to better retain a bowstring with a large diameter due to forming an inner radius of the rear edges that is substantially the same as the diameter of the larger bowstring.

Referring now to FIGS. 12A-12K, an anti-dry tire (ADF) mechanism 1200 and bolt detection system is shown according to another embodiment of the present disclosure. The ADF mechanism 1200 may operate using any of the flocks of FIGS. 4A-11E described above. For illustrative purposes, however, the ADF mechanism 1200 is shown in these figures with a bolt 200 that is using nock 312 of FIGS. 10A-10E. Thus, it will be understood that the principles described in connection with the ADF mechanism will apply to other flocks that have lobes as well as the one shown as an example in these figures.

The ADF mechanism 1200 may be part of a firing mechanism of a crossbow (e.g., crossbow 100). In these figures, the stock or handle of the crossbow is not shown, but the firing mechanism may be housed within a handle or stock. The ADF mechanism 1200 may comprise a string retaining member 1202, a release member 1204, and an ADF member 1206 (i.e., a nock contact member). The string retaining member 1202, release member 1204, and ADF member 1206 may each be pivotally connected to the stock or handle of the crossbow by pivot points 1208, 1210, and 1212, respectively.

FIGS. 12A-12K each show a different step in a bolt detection and launching process. Starting in FIG. 12A, the crossbow is unloaded and the bowstring 120 is not in a fully cocked position. Thus, the bowstring 120 and bolt 200 are entirely positioned forward of the string retaining member 1202. The release member 1204 is in a first position wherein it is in contact with a holding surface 1214 on the string retaining member 1202. The ADF member 1206 is also in a locked position wherein a holding surface 1216 on the ADF member 1206 is in contact with the release member 1204 and a contact portion 1218 of the ADF member 1206 is not in contact with the bolt 200.

Figure 12A:
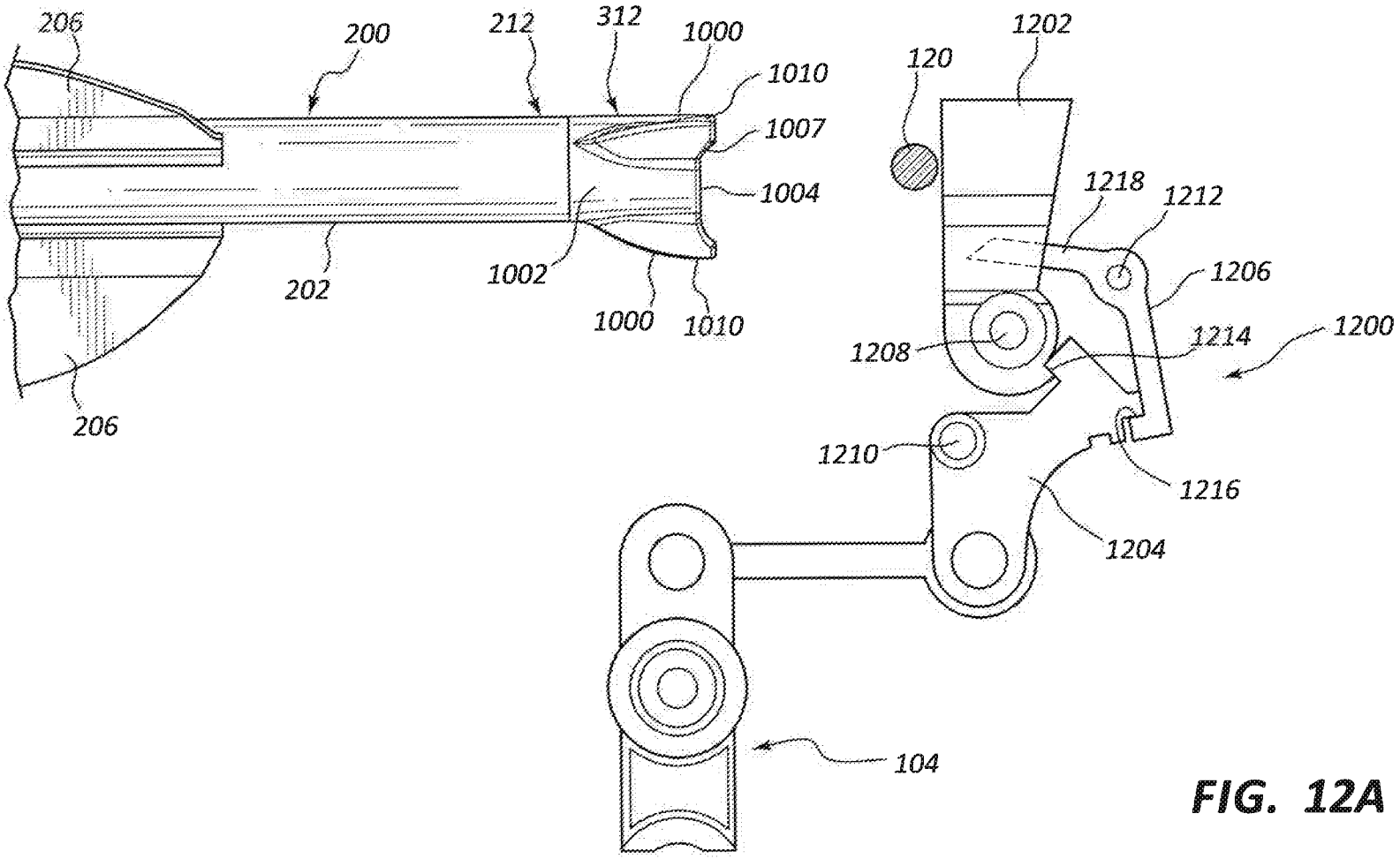
Figure 12B:
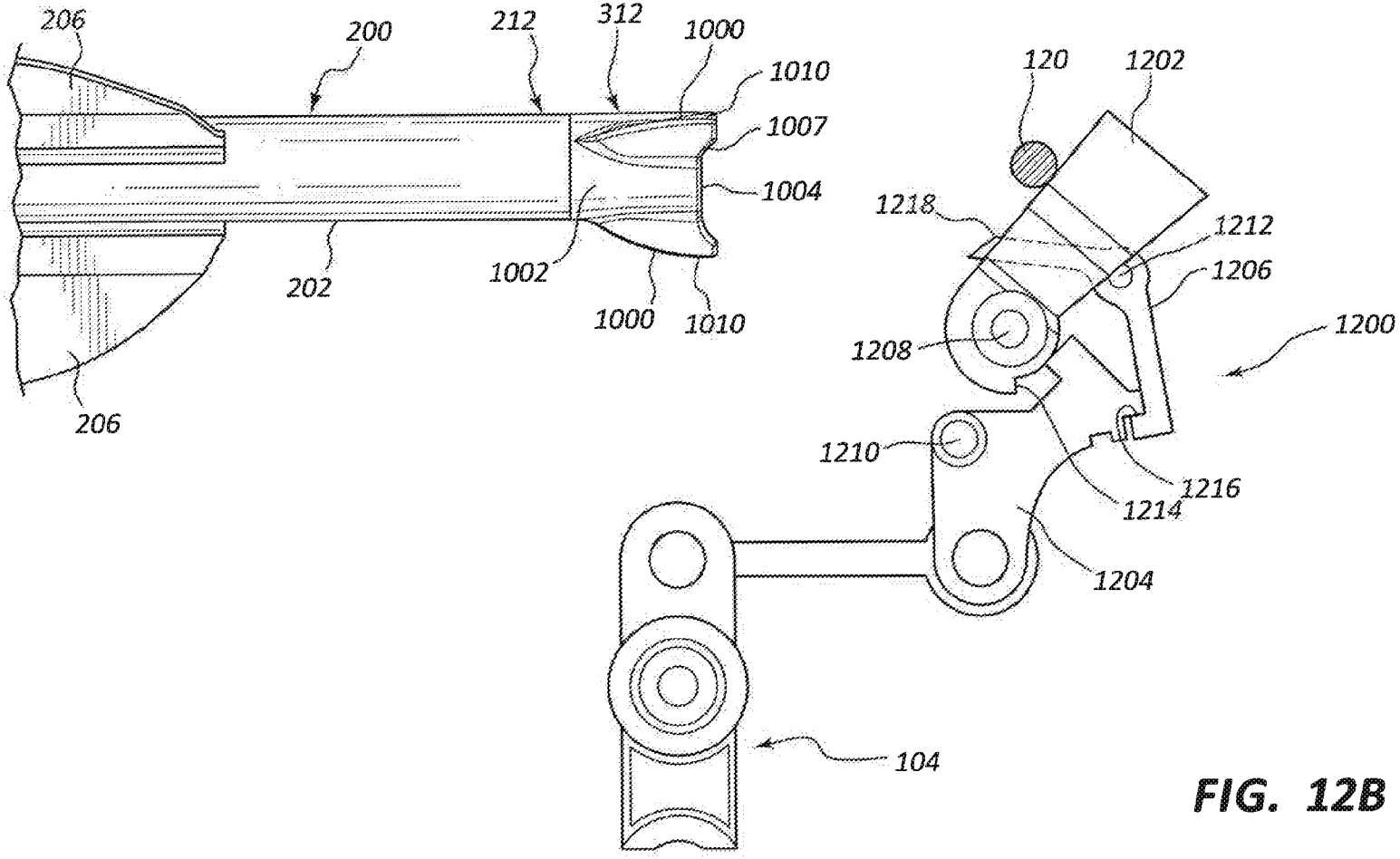
Figure 12C:
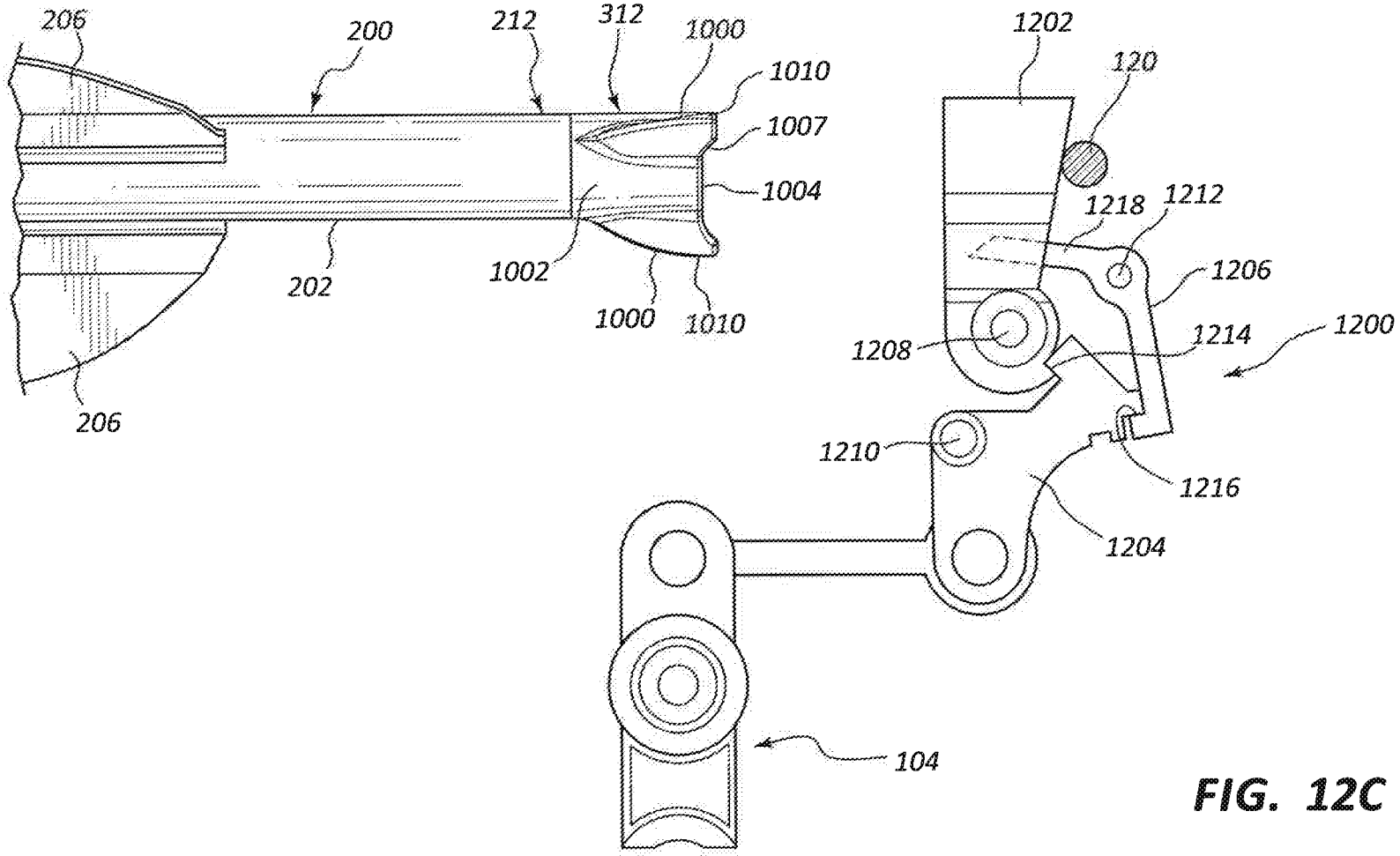

FIG. 12B shows the bowstring 120 partially loaded into the ADF mechanism 1200. The string retaining member 1202 is rotated around pivot point 1208 to accommodate the rearward movement of the bowstring 120. As the bowstring 120 continues to move rearward, the string retaining member 1202 will continue to rotate until the bowstring 120 passes over the string retaining member 1202, at which point the string retaining member 1202 returns to its first position, the bowstring release prevention position, as shown in FIG. 12C. To complete this process, the string retaining member 1202 may in some embodiments be spring loaded around the pivot point 1208 such that the string retaining member 1202 is biased back to its first position once the bowstring 120 passes over it. Once the bowstring 120 is in the position of FIG. 12C, it is kept from moving forward (i.e., retained) by the string retaining member 1202 since the holding surface 1214 is in contact with the release member 1204, which prevents further counterclockwise rotation of the string retaining member 1202. At this point, the crossbow may be referred to as being cocked and ready for the bolt 200 to be loaded.

In the position of FIG. 12C, the holding surface 1216 of the ADF member 1206 stays in contact with the release member 1204 and thereby prevents rotation of the release member 1204 to a position out of contact with the holding surface 1214 of the string retaining member 1202. Thus, the interference of the string retaining member 1202, release member 1204, and ADF member 1206 prevents the string retaining member 1202 from moving and allowing the bowstring 120 to be released without a bolt 200 being loaded (i.e., prevents a dry fire of the crossbow 100).

Figure 12D:
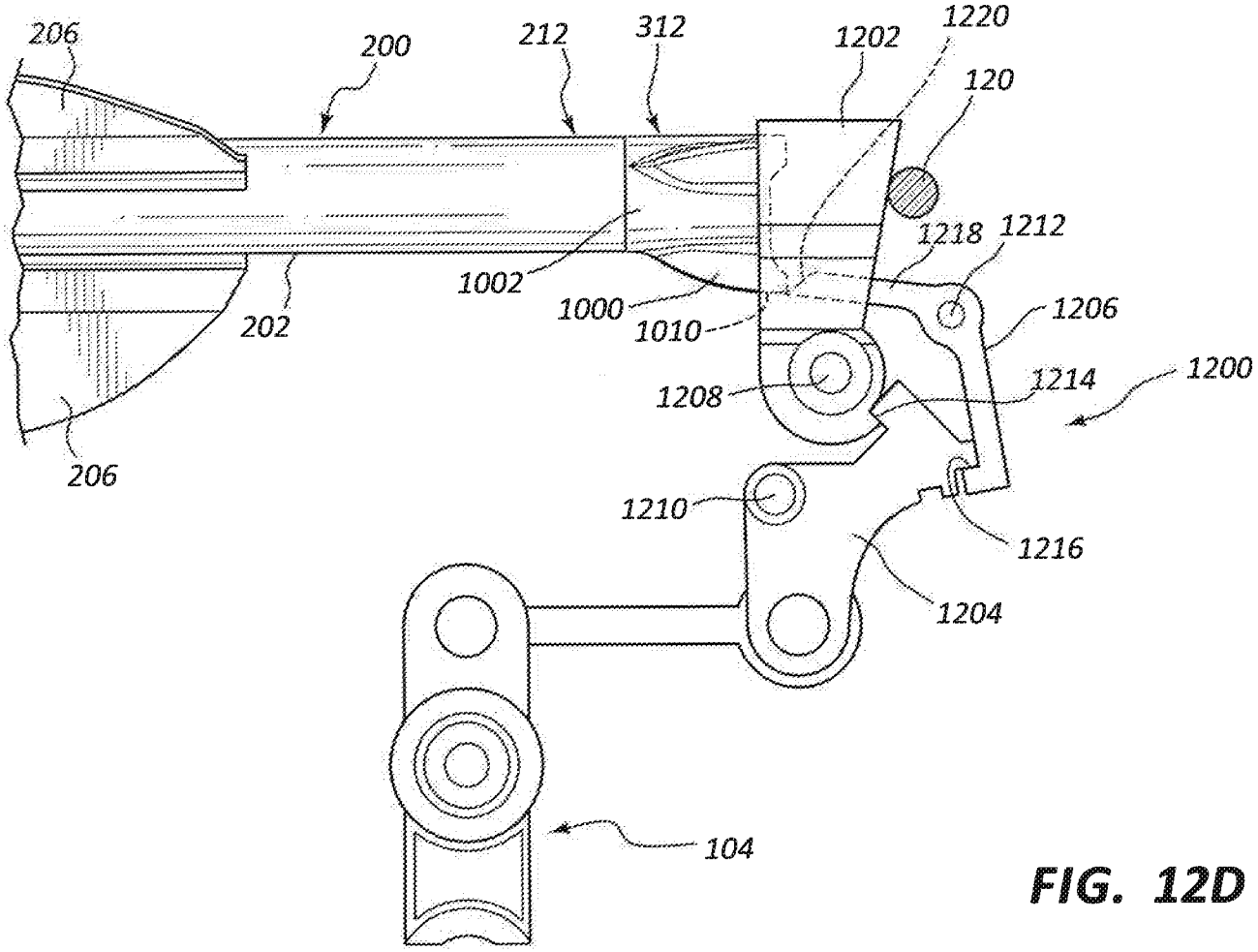
Figure 12E:
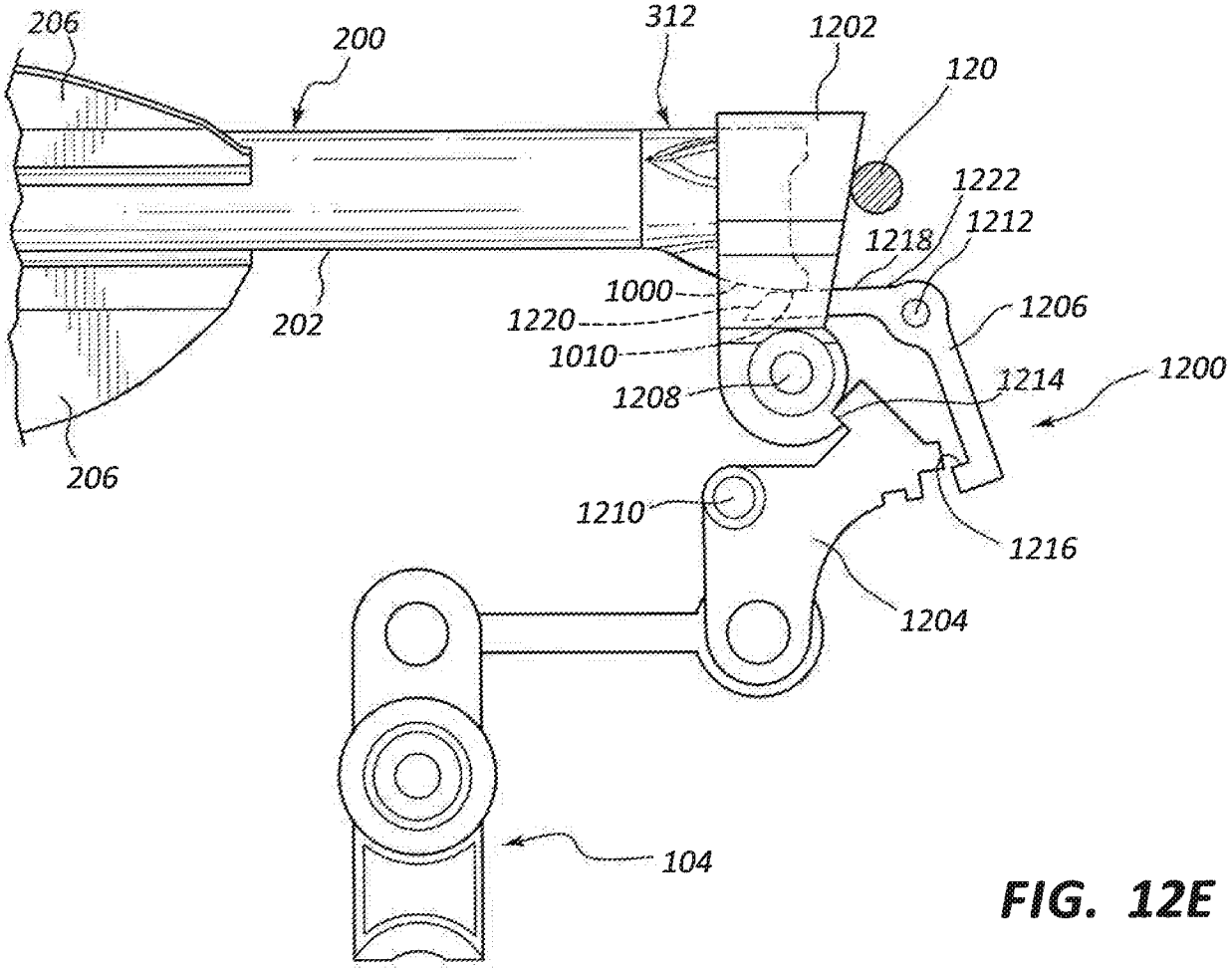
Figure 12F:
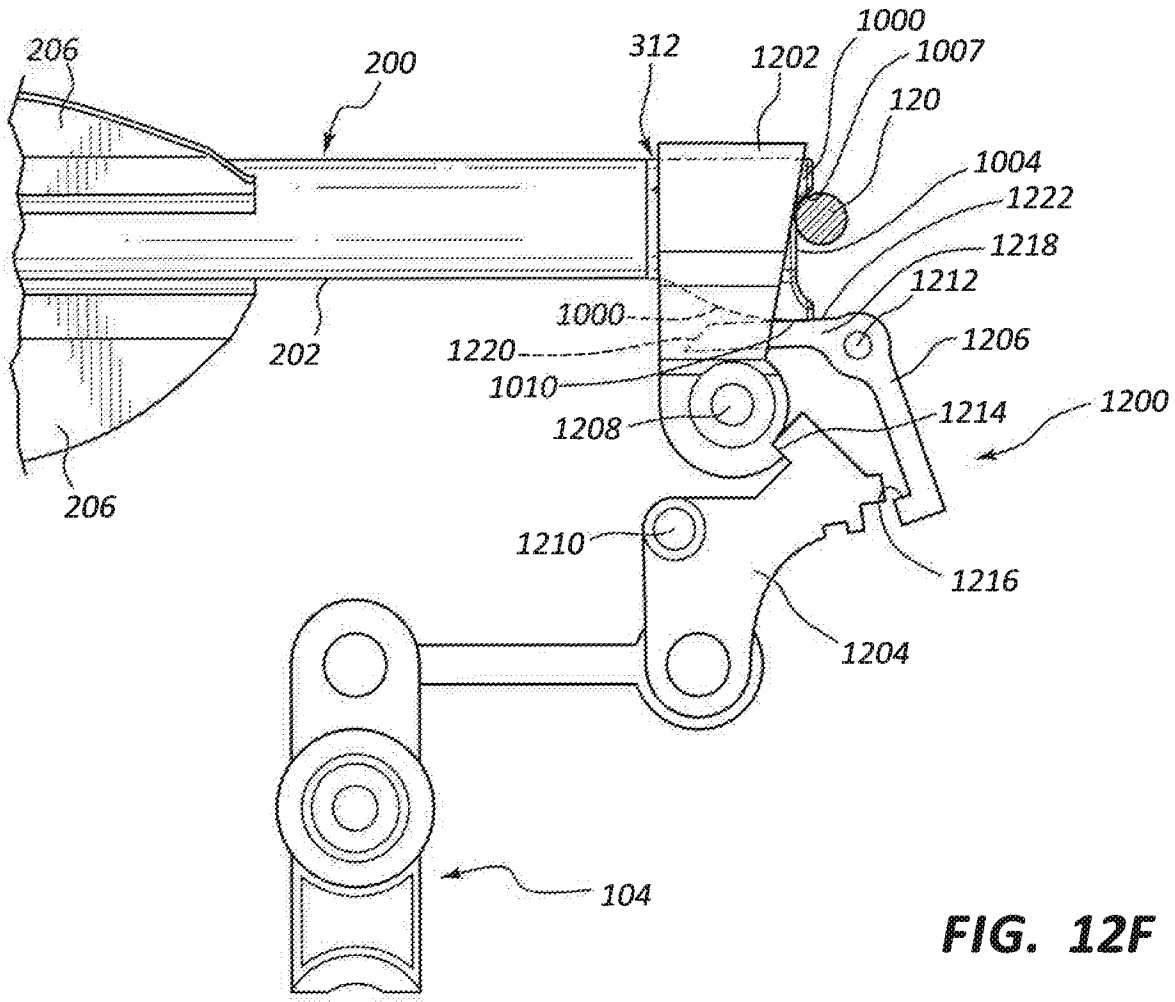

FIGS. 12D-12F illustrate the bolt 200 loading process. Between the positions of FIGS. 12C and 12D, the bolt 200 moves rearward (e.g., by sliding on the rails 110) until the nock 312 comes into contact with the contact portion 1218 of the ADF member 1206, as shown in FIG. 12D. The contact portion 1218 of the ADF member 1206 may have an angled or sloped surface 1220 that makes first contact with the lobe being used as the index lobe of the nock 312. In FIG. 12D, the ADF member 1206 has not yet rotated.

FIG. 12E shows the ADF mechanism 1200 after the bolt 200 has moved further rearward and partially through the string retaining member 1202. The index lobe of the nock 312 has pressured the sloped surface 1220 of the ADF member 1206 enough to cause the ADF member 1206 to rotate around its pivot point 1212 and to give way to the nock 312 to allow the outer ridge 1010 of the nock to slide along a detection surface 1222 on the top of the ADF member 1206. The rotation of the ADF member 1206 also causes the holding surface 1216 of the ADF member 1206 to move out of contact with the release member 1204, but the bowstring 120 remains retained by the string retaining member 1202 due to contact of the holding surface 1214 of the string retaining member 1202 with the release member 1204.

The detection surface 1222 may be called a detection surface because while the index lobe of the nock 312 is in contact with the detection surface 1222, the ADF mechanism 1200 detects the presence of a bolt 200 loaded into the crossbow 100. If the bolt 200 is pulled forward and out of this position, the ADF member 1206 may rotate back into the position of FIG. 12D to prevent dry fire of the crossbow 100. In some embodiments, the ADF member 1206 is biased toward that position in order to help automatically prevent dry fires.

In some embodiments, the crossbow 100 may be designed so that the sloped surface 1220 and/or detection surface 1222 are positioned at a predetermined vertical distance below the top of the rails 110 and within the flight groove 108 of the crossbow 100. This predetermined vertical distance may correspond with a height of an index lobe relative to the surface of the shaft 202 of the bolt 200. Thus, a bolt loaded into the crossbow 100 would need to have an index lobe on its rear end in order for the crossbow 100 to launch the bolt since a conventional bolt nock would not extend downward that predetermined vertical distance and make contact with the ADF member 1206. Consequentially, the lobe of the nock 312 also provides automatic longitudinal position detection of the bolt 200 since the bolt 200 would need to be in contact with the detection surface 1222 at a specific longitudinal position in order for the ADF mechanism 1200 to detect the bolt 200. The crossbow 100 would not be able to shoot the bolt 200 without the ADF mechanism 1200 detecting the bolt 200.

In the position shown in FIG. 12F, the bolt 200 is fully loaded. The nock 312 is in contact with the bowstring 120 and the ADF member 1206 is rotated with the holding surface 1216 out of the path of rotation of the release member 1204 (e.g., when the release member 1204 rotates around pivot point 1210). The bowstring 120 may be in contact with one or more of the rear surface 1004 and lobe edges 1007 of the nock 312. The bowstring 120 and bolt 200 may remain in this loaded position with the ADF member 1206 unlocked until the trigger assembly 104 is actuated by the user.

FIG. 12F also illustrates how the lobe edges 1007 may interfere with movement of the bowstring 120 if it tries to slip around the nock 312 and along the shaft 202 of the bolt 200. A vertical movement of the bowstring 120 would also move the nock 312 upward or downward with the bowstring 120 due to contact with the lobes 1000, thereby keeping the bowstring 120 cradled or captured behind the nock 312 and able to continue to transfer its potential energy to the bolt 200.

Figure 12G:
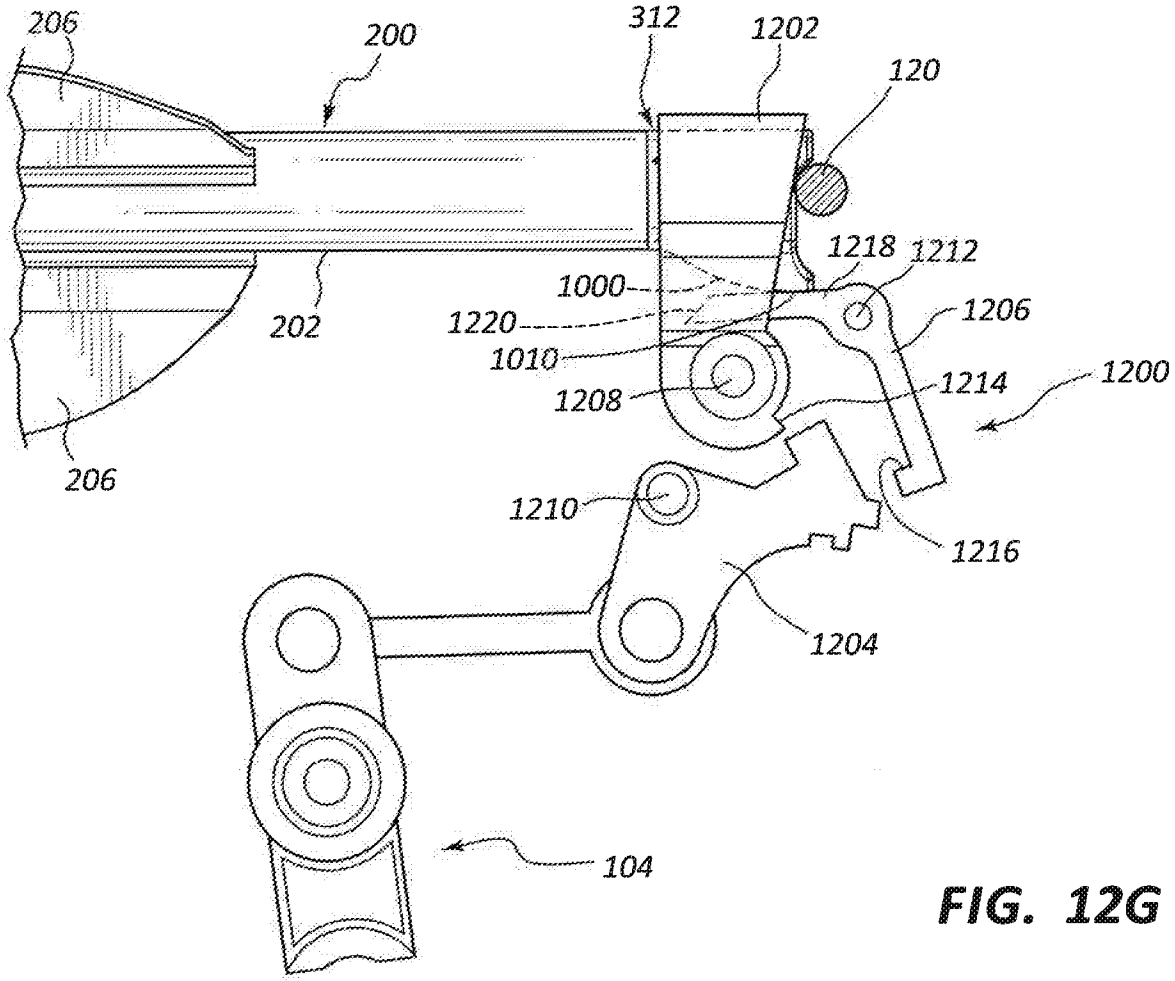
Figure 12H:
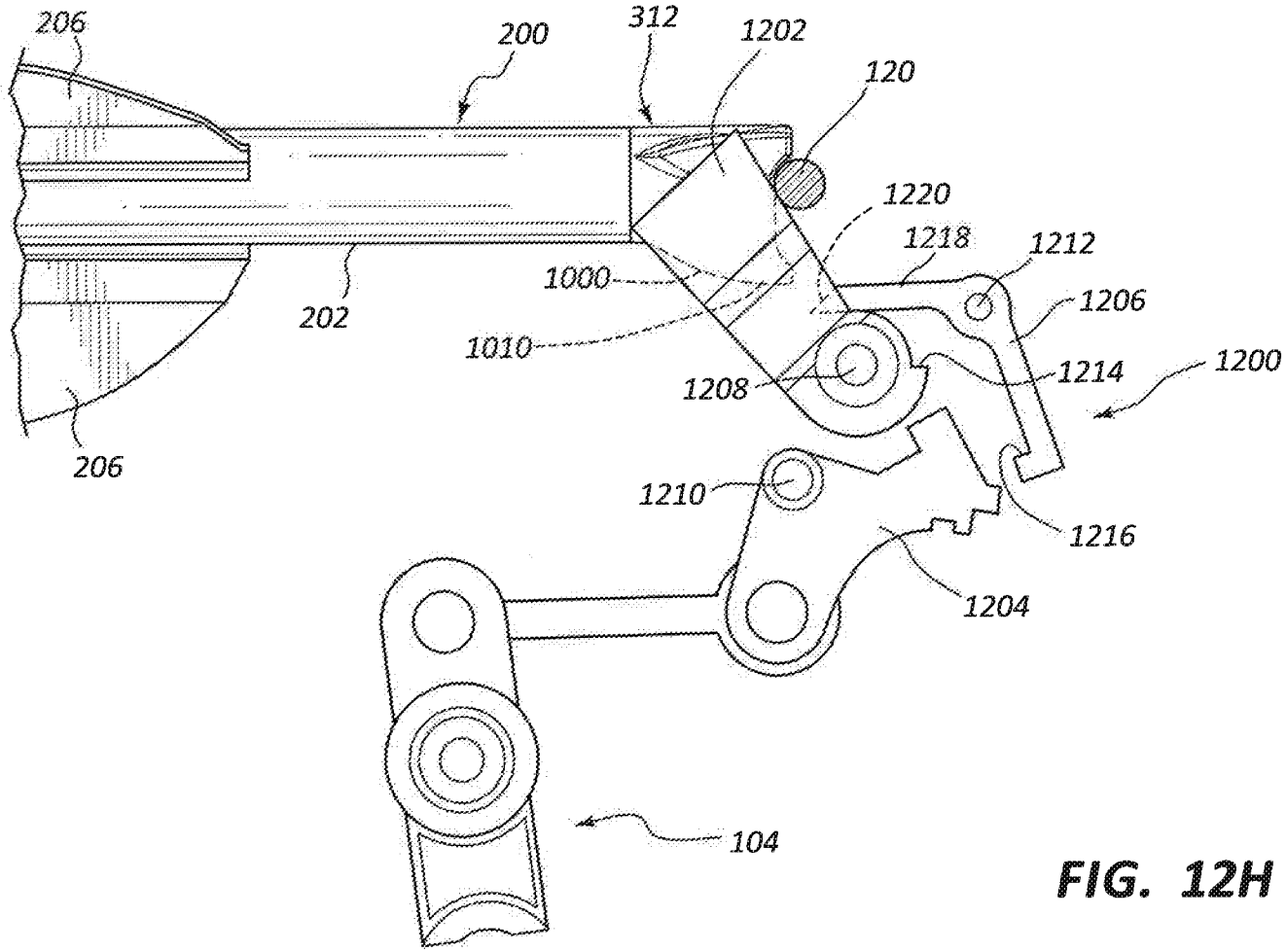
Figure 12I:
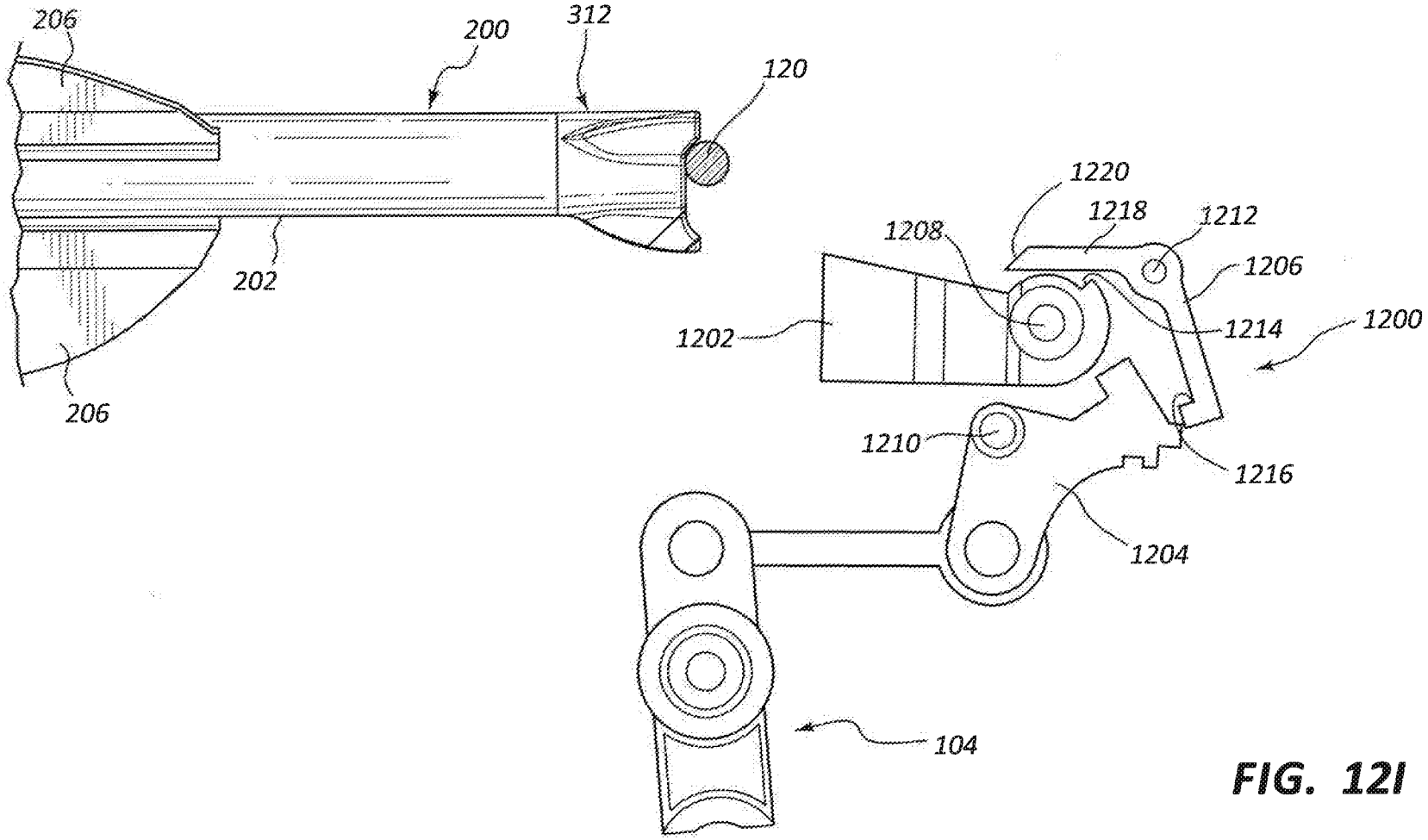

FIGS. 12G-12I illustrate the bolt launching process. FIG. 12G shows the state of the ADF mechanism 1200 momentarily after the trigger assembly 104 is pulled. The release member 1204 rotates around its pivot point 1210, thereby moving out of contact with the holding surface 1214 of the string retaining member 1202. The tension in the bowstring 120 is applied to the string retaining member 1202, so the string retaining member 1202 rotates to the position shown in FIG. 12H. As the bowstring 120 moves forward, it is held against the nock 312 and pushes the bolt 200 forward as well. The string retaining member 1202 continues to rotate out of the way of the bowstring 120 and may eventually reach the position shown in FIG. 12I. In FIG. 12I, the bowstring 120 is completely out of contact with the string retaining member 1202, which has rotated down and out of the way of the bowstring 120 as the bowstring 120 passed over it while propelling the bolt 200 forward. Eventually the tension applied to the bowstring 120 is released, and the bolt 200 is launched away from the crossbow 100 at high velocity. The bowstring 120 remains in contact with the nock 312 from the position shown in FIG. 12F until the bowstring 120 stops moving forward.

FIG. 12J shows the string retaining member 1202 and ADF member 1206 as they spring back into their first positions, which are shown in FIG. 12K. Once returning to the position of FIG. 12K (which is comparable to the position of FIG. 12A), the holding surfaces 1214, 1216 remain in contact with the release member 1204 until the crossbow 100 is cocked and loaded over again.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

What is claimed is:

1. A lobed projectile configured to be used in a crossbow, the projectile comprising:

a shaft having a leading end and a trailing end;

a point positioned at the leading end;

a plurality of circumferentially spaced apart vanes positioned on the shaft between the leading end and the trailing end;

a nock positioned at the trailing end, the nock comprising:

a body portion attached to the shaft, the body portion having a central axis;

a lobe on the outer surface of the body portion, the lobe extending radially away from the central axis, the lobe configured to substantially occupy a gap between two rails of a crossbow.

2. The lobed projectile of claim 1, wherein the lobe is longitudinally aligned with one of the plurality of circumferentially spaced apart vanes.

3. The lobed projectile of claim 1, wherein the nock comprises a plurality of lobes on the outer surface of the body portion and extending radially away from the central axis.

4. The lobed projectile of claim 3, wherein the nock further comprises a plurality of bowstring seats, each of the bowstring seats being formed by at least two of the lobes of the plurality of lobes.

5. The lobed projectile of claim 4, wherein the bowstring seats each have a seat axis, and the seat axes collectively form a triangle relative to the body portion.

6. The lobed projectile of claim 1, wherein the nock comprises a bowstring seat having an at least partially cylindrical bowstring contact surface.

7. The lobed projectile of claim 1, wherein the body portion has a rear surface and the lobe extends rearward from the body portion relative to the rear surface.

8. The lobed projectile of claim 1, wherein the nock further comprises a flat rear surface.

9. The lobed projectile of claim 1, wherein the nock further comprises a recessed rear surface.

10. The lobed projectile of claim 1, wherein the lobe comprises a retaining surface facing the body portion.

11. A nock for a projectile crossbow bolt, the nock comprising:

a front end portion configured to be inserted into a shaft of a crossbow projectile, the front end portion having a longitudinal axis;

a rear end portion configured to extend rearward from the shaft upon insertion of the front end portion into the shaft;

a lobe attached to the rear end portion and extending away from the rear end portion in a radial direction relative to the longitudinal axis, the lobe being configured to be substantially equal to a flight groove width of a crossbow.

12. The nock of claim 11, wherein a plurality of lobes are attached to the rear end portion and radially extend away from the rear end portion relative to the longitudinal axis, the plurality of lobes being circumferentially spaced apart around the rear end portion.

13. The nock of claim 12, wherein one of the plurality of lobes is configured to extend in a vertical direction away from the rear end portion and at least two other lobes of the plurality of lobes extend laterally relative to the vertical direction.

14. The nock of claim. 11, wherein the rear end portion has a flat rear surface.

15. The nock of claim 11, wherein the rear end portion has a central portion and a peripheral portion, the central portion being recessed relative to the peripheral portion.

16. The nock of claim 11, wherein the lobe extends rearward from the rear end portion.

17. The nock of claim 11, wherein the lobe has a curved rear surface.

18. The nock of claim 17, wherein the rear end portion has an at least partially cylindrical bowstring contact surface.

19. The nock of claim 18, wherein the cylindrical bowstring contact surface is positioned relative to the rear end portion such that a bowstring contacting the cylindrical bowstring contact surface intersects the longitudinal axis.

20. The nock of claim 11, wherein the lobe has a pointed outer surface facing radially away from the longitudinal axis.

21. The pock of claim 11, wherein the lobe has a flat outer surface facing radially away from the longitudinal axis.

* * * * *